US007773921B2

(12) United States Patent
Fujishima et al.

(10) Patent No.: US 7,773,921 B2
(45) Date of Patent: Aug. 10, 2010

(54) IMAGE FORMING APPARATUS WITH TONER COLLECTING ROLLER

(75) Inventors: Masashi Fujishima, Osaka (JP); Kiyotaka Kobayashi, Osaka (JP); Yuki Matsui, Osaka (JP); Yukihiro Mori, Osaka (JP); Sayo Uemura, Osaka (JP); Akihiro Watanabe, Osaka (JP)

(73) Assignee: Kyocera Mita Corporation (JP)

( * ) Notice: Subject to any disclaimer, the term of this patent is extended or adjusted under 35 U.S.C. 154(b) by 230 days.

(21) Appl. No.: 12/019,744

(22) Filed: Jan. 25, 2008

(65) Prior Publication Data

US 2008/0181675 A1 Jul. 31, 2008

(30) Foreign Application Priority Data

| | | |
|---|---|---|
| Jan. 29, 2007 | (JP) | 2007-018544 |
| Jan. 29, 2007 | (JP) | 2007-018545 |
| Jan. 29, 2007 | (JP) | 2007-018546 |
| Jan. 29, 2007 | (JP) | 2007-018547 |
| Jan. 31, 2007 | (JP) | 2007-020948 |
| Jan. 31, 2007 | (JP) | 2007-020950 |
| Jan. 31, 2007 | (JP) | 2007-020951 |

(51) Int. Cl.
*G03G 15/09* (2006.01)

(52) U.S. Cl. ..... 399/273; 399/272

(58) Field of Classification Search ..... 399/267, 399/270, 272, 273

See application file for complete search history.

(56) References Cited

U.S. PATENT DOCUMENTS 5,832,350 A * 11/1998 Kumasaka et al. ..... 399/272 X

FOREIGN PATENT DOCUMENTS

| | | |
|---|---|---|
| JP | 8-137256 | 5/1996 |
| JP | 2003-280357 | 10/2003 |
| JP | 2005-157002 | 6/2005 |
| JP | 2005-242194 | 9/2005 |

* cited by examiner

*Primary Examiner*—Sandra L Brase
(74) *Attorney, Agent, or Firm*—Gerald E. Hespos; Michael J. Porco

(57) ABSTRACT

An image forming apparatus includes a latent image carrying member, a two-component developer carrying member holding on an outer surface a developer containing carrier beads and toner particles, the two-component developer carrying member having a first magnetic element mounted therein, a toner carrying member carrying a thin toner layer on an outer surface, a toner collecting roller for collecting the toner particles scattered and suspended in the vicinity of the two-component developer carrying member and the toner carrying member, the toner collecting roller having a second magnetic element mounted therein, and a housing accommodating the two-component developer carrying member, the toner carrying member and the toner collecting roller. The toner collecting roller is located face to face with the two-component developer carrying member with the first and second magnetic elements disposed to face each other with oppositely directed polarities.

17 Claims, 13 Drawing Sheets

NO GHOST ON 1000TH PRINTOUT

GHOST ON 1000TH PRINTOUT

IMAGE FORMING APPARATUS WITH TONER COLLECTING ROLLER

BACKGROUND OF THE INVENTION

1. Field of the Invention

The present invention relates to image forming apparatuses using electrophotography, such as copying machines, printers, facsimile machines and hybrid machines thereof.

2. Description of the Related Art

Mono-component development and two-component development are conventionally known examples of developing technology employed in electrophotographic image forming apparatuses using dry toner particles.

A mono-component development system is suited for high-quality imaging. This is because a mono-component developer does not contain carrier beads and, thus, an electrostatic latent image formed on a photoreceptor is not disturbed by a magnetic brush produced by a combination of carrier beads and toner particles. It is however difficult to maintain a stable amount of electrostatic toner charge in the mono-component development system. Additionally, color toner particles should necessarily be nonmagnetic as the color toner particles are required to have light transmitting properties. For this reason, a full-color image forming apparatus usually employs a two-component developing system using developers containing carrier beads which serve as a medium for charging and carrying toner particles.

An image forming method based on the two-component developing system employs so-called touchdown development (also known as hybrid development) in which a magnetic brush formed on a developer carrying member (magnetic roller) carrying a two-component developer creates a thin toner layer on a toner carrying member (development roller) and part of this thin toner layer is transferred to a latent image carrying member (e.g., a photosensitive drum) to develop an electrostatic latent image formed thereon. This method of development however has a problem that there is a difference between a proper amount of electrostatic toner charge at the time of developing the electrostatic latent image and a proper amount of electrostatic toner charge at the time of forming the thin toner layer. Therefore, the two-component image forming method is associated with such problems as low image density due to an insufficient amount of toner particles in the thin toner layer and a development ghost caused by inadequate removal of that portion of the thin toner layer which is left unused for development on the development roller.

One factor causing the aforementioned problems would be toner scattering which can occur chiefly within a developing device in a process of stirring the toner particles in a housing or in the vicinity of a magnetic roller, for example. The toner particles scattered in the developing device spread inside the electrophotographic apparatus in which a photosensitive drum, an optical system, a charging device, an image transfer device and so on are disposed, thus causing various kinds of image forming failures and malfunctions including the aforementioned problems.

In an attempt to overcome such problems of the prior art, Japanese Unexamined Patent Publication No. 1996-137256 proposes an arrangement for preventing toner scattering by using a scattering prevention member and scraping means (blade). The scattering prevention member is rotatably mounted face to face with a photosensitive drum with a narrow gap therebetween whereby a developer which is dispersed when supplied attaches to a surface of the scattering prevention member, thus preventing developer particles from scattering to the exterior of a developing device. The scraping means scrapes off the developer particles adhering to the scattering prevention member.

On the other hand, Japanese Unexamined Patent Publication No. 2005-242194 proposes an arrangement for a two-component type developing device. This arrangement includes a toner collecting roller provided in an opening of a housing of the developing device for collecting scattered toner particles. The collected toner particles are scraped off the toner collecting roller and returned to the developing device.

According to the arrangement of Japanese Unexamined Patent Publication No. 1996-137256, however, the developer particles scraped off the scattering prevention member are subjected to stress due to mechanical contact with the blade and this stress accelerates deterioration of the developer. Particularly in touchdown development, the developer is susceptible to the influence of selective development. Specifically, the stress caused by the scraping with the blade can cause external additive particles to be separated from or buried in toner particles. This would cause a change in charging characteristics of the toner particles. When the toner particles with modified charging characteristics returns to a two-component developer storage space, toner scattering and selective development would be accelerated and a reduction in image density would result, making it difficult to ensure stable image forming operation for a long period of time.

Since toner particles left unused for development on a development roller are collected by a magnetic brush in touchdown development, the collected toner particles have low adhesion to carrier beads compared to those used for ordinary two-component development. In addition, since toner concentration in the two-component developer used in touchdown development is made higher than that for the ordinary two-component developing system, the two-component developer for touchdown development has low fluidity. Therefore, during a process of toner collection, the developer is pushed in and compressed and, at the same time, surrounding air masses can find no way to go but to escape to the exterior of the developing device together with entrained toner particles, so that toner scattering is more likely to occur in touchdown development systems.

According to the arrangement of Japanese Unexamined Patent Publication No. 2005-242194, on the other hand, it is necessary to provide a dedicated path for returning unused toner particles to the developing device after collecting the scattered toner particles with the toner collecting roller and scraping the collected toner particles therefrom. This arrangement is disadvantageous in that the provision of the toner returning path results in an increase in machine size. Another disadvantage of this arrangement is that a blade or like means provided for scraping off the collected toner particles from toner collecting roller accelerates deterioration of the toner particles.

What is most problematic in the touchdown development system is a development ghost phenomenon. It is important to scrape off unused toner particles adhering to the development roller by means of the magnetic roller to overcome the ghost phenomenon. As process line speed increases, it is needed to supply an adequate amount of toner particles necessary for developing a larger number of electrostatic latent images to the toner carrying member (development roller) in a short time and, because the period of time available for forming a toner layer decreases, there arises the need to take measures to increase the toner concentration in the two-component developer, for instance. This means that the two-component developer collected and returned to the two-component developer storage space after formation of the toner layer has a higher toner concentration when the process line speed is high compared to a case where the process line speed is low.

Moreover, since the period of time available for scraping off the unused toner particles from the development roller becomes shorter and the toner concentration in the two-component developer collected and returned to the two-component developer storage space becomes higher, it is more difficult to scrape off the unused toner particles from the development roller at increased process line speeds. Additionally, toner scattering is more likely to occur and the scattered toner particles may adhere to the development roller at increased process line speeds, resulting in an increase in the amounts of collected toner particles and scattered toner particles and an increased tendency for the ghost phenomenon to occur due to inadequate removal of the unused toner particles.

Especially in such a high-speed machine based on the touchdown development system with a drum line speed of 180 mm/sec or higher, it is even more difficult to collect the scattered toner particles. For example, a high-speed machine with a drum line speed of 180 mm/sec can print on approximately 40 sheets of A4-size paper per minute in landscape format, those with a drum line speed of 250 mm/sec can print on approximately 50 sheets of A4-size paper per minute in landscape format, and those with a drum line speed of 340 mm/sec can print on approximately 60 sheets of A4-size paper per minute in landscape format.

SUMMARY OF THE INVENTION

It is an object of the present invention to provide an image forming apparatus including a developing device using touchdown development technology featuring capabilities to suppress toner scattering and deterioration of toner particles and ensure stable image forming quality for a long period of time.

According to one aspect of the invention, an image forming apparatus configured to achieve the aforementioned object includes a latent image carrying member, a two-component developer carrying member holding on an outer surface a developer containing carrier beads and toner particles, the two-component developer carrying member having a first magnetic element mounted therein, a toner carrying member carrying a thin toner layer on an outer surface, a toner collecting roller for collecting the toner particles scattered and suspended in the vicinity of the two-component developer carrying member and the toner carrying member, the toner collecting roller having a second magnetic element mounted therein, and a housing accommodating the two-component developer carrying member, the toner carrying member and the toner collecting roller.

In a developing device of the image forming apparatus thus configured, the toner collecting roller is located between the two-component developer carrying member and an inside wall of the housing at a location downstream of an area where the two-component developer carrying member and the toner carrying member are closest to each other with respect to a rotating direction of the two-component developer carrying member, and the toner particles scattered and adhering to the toner collecting roller are retrieved by a magnetic brush formed on the outer surface of the two-component developer carrying member.

In an image forming apparatus according to another aspect of the invention, the toner collecting roller is disposed face to face with the two-component developer carrying member, and the first and second magnetic elements are disposed to face each other with oppositely directed polarities.

According to a still another aspect of the invention, the image forming apparatus further includes a toner-collecting developer carrying member disposed face to face with the toner carrying member and carrying the two-component developer for collecting the toner particles from the toner carrying member, the toner-collecting developer carrying member having a magnetic element mounted in therein. The toner-collecting developer carrying member and the toner carrying roller are in a counter-rotation configuration so that closest facing parts of these two rollers move in opposite directions, and the toner collecting roller is disposed face to face with both the toner-collecting developer carrying member and the toner carrying member.

These and other objects, features and advantages of the invention will become more apparent upon a reading of the following detailed description in conjunction with the accompanying drawings.

DETAILED DESCRIPTION OF THE PREFERRED EMBODIMENTS

Specific embodiments of the present invention are now described in detail with reference to the accompanying drawings.

First Embodiment

Figure 1:
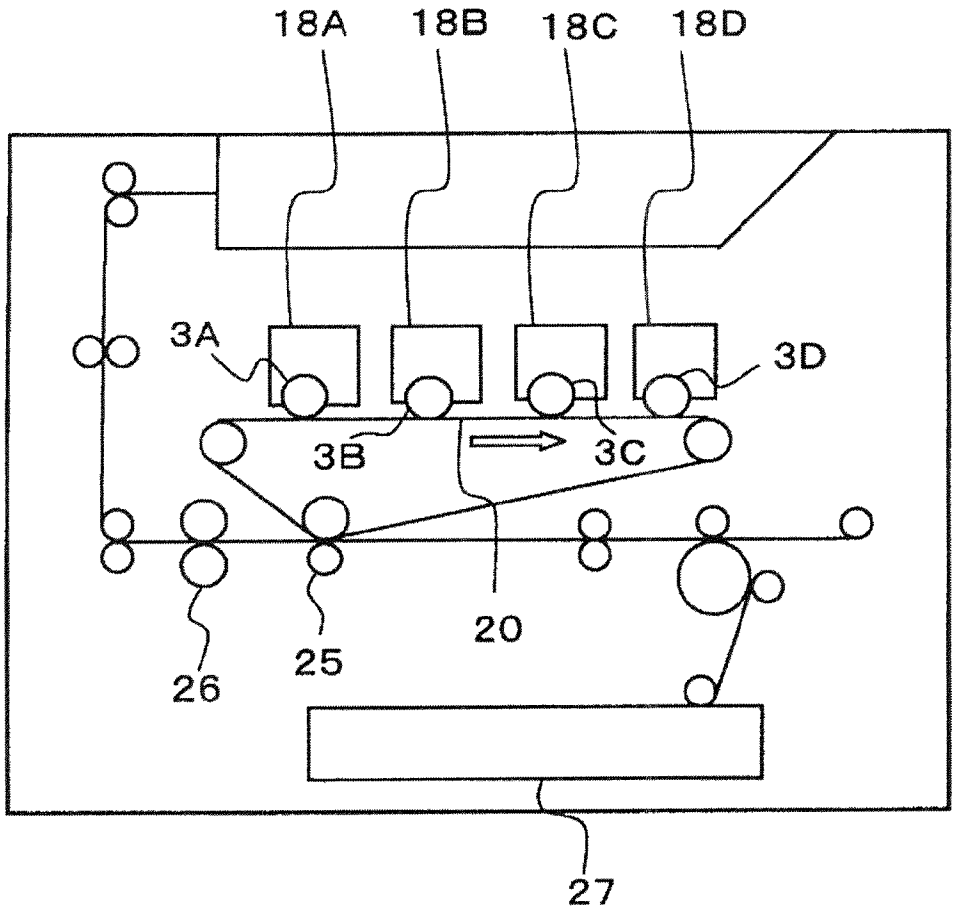
FIG. 1 is a schematic constructional diagram showing an example of a tandem-type color image forming apparatus provided with one of developing units according to first to seventh embodiments of the invention.

FIG. 1 is a schematic constructional diagram showing an example of a tandem-type color image forming apparatus provided with developing units 18A, 18B, 18C, 18D according to a first embodiment of the invention. It is to be noted that the constructional diagram of FIG. 1 is applied also to later-described second to seventh embodiments.

As shown in FIG. 1, the image forming apparatus includes four image forming modules provided individually with photosensitive drums 3A, 3B, 3C, 3D and an intermediate transfer belt 20 to which toner images are sequentially transferred from the image forming modules. The photosensitive drums 3A, 3B, 3C, 3D are arranged in tandem above the intermediate transfer belt 20 to constitute an indirect transfer tandem engine. The image forming apparatus further includes a secondary transfer roller 25 for transferring a superimposed color toner image formed on the intermediate transfer belt 20 to a printing sheet, a fixing roller 26 for fixing the transferred toner image to the printing sheet and a paper cassette 27 for storing a plurality of printing sheets.

The four image forming modules include the aforementioned developing units 18A, 18B, 18C, 18D holding magenta, cyan, yellow and black toner particles, respectively. These developing units 18A, 18B, 18C, 18D supply the toner particles to the respective photosensitive drums 3A, 3B, 3C, 3D to develop electrostatic latent images on the drums 3A, 3B, 3C, 3D into visible toner images.

The toner images formed on the individual photosensitive drums 3A, 3B, 3C, 3D are sequentially transferred to a surface of the intermediate transfer belt 20, starting from the photosensitive drum 3A on an upstream side. The secondary transfer roller 25 transfers a full-color toner image formed on the intermediate transfer belt 20 to a printing sheet fed from the paper cassette 27 and the fixing roller 26 fixes the toner image to the printing sheet. Subsequently, the printing sheet carrying the color image is discharged to a delivery tray provided at the top of the image forming apparatus.

Figure 2:
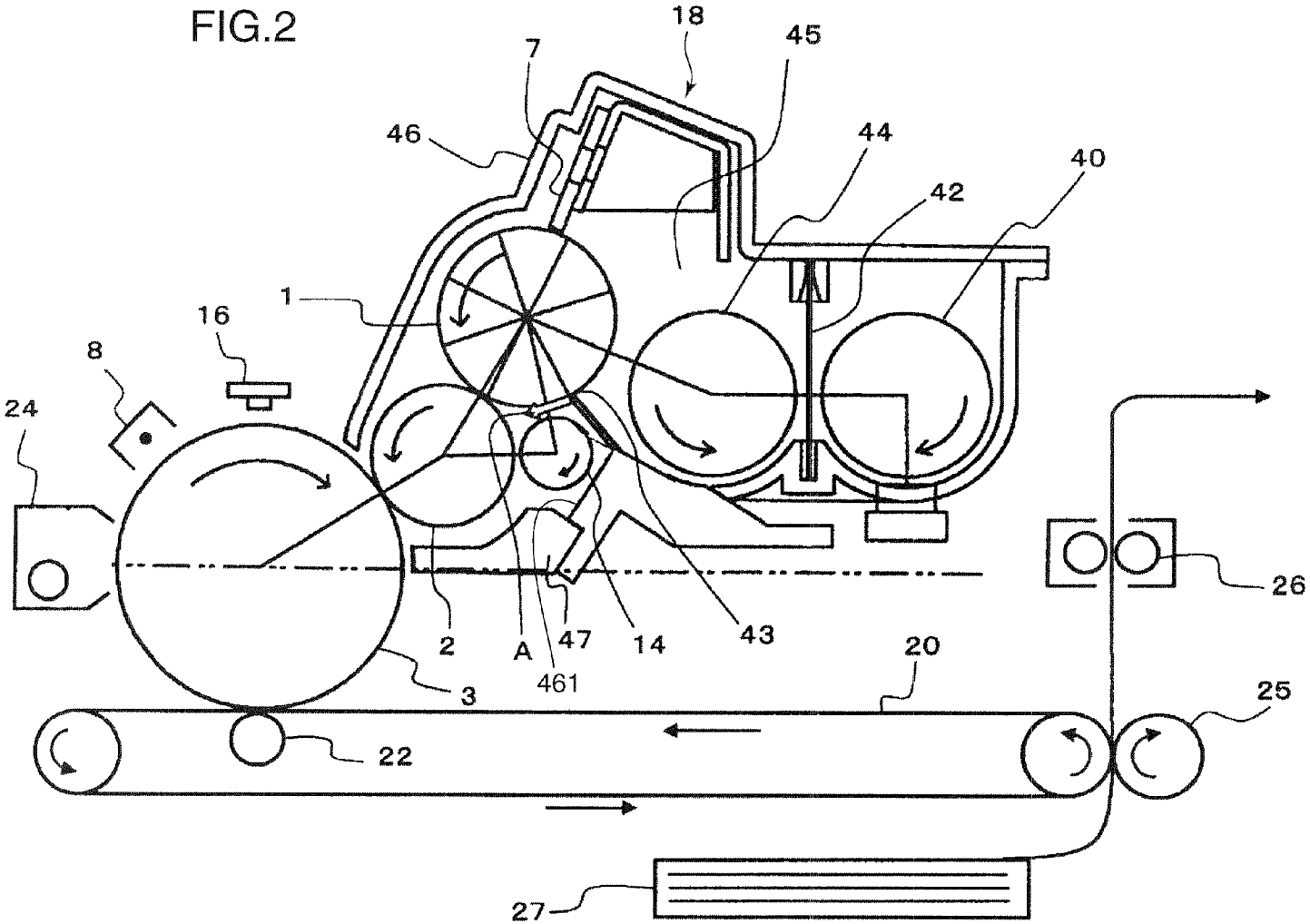
FIG. 2 is an explanatory diagram generally showing the configuration of the image forming apparatus using touchdown development according to the first embodiment.
Figure 3:
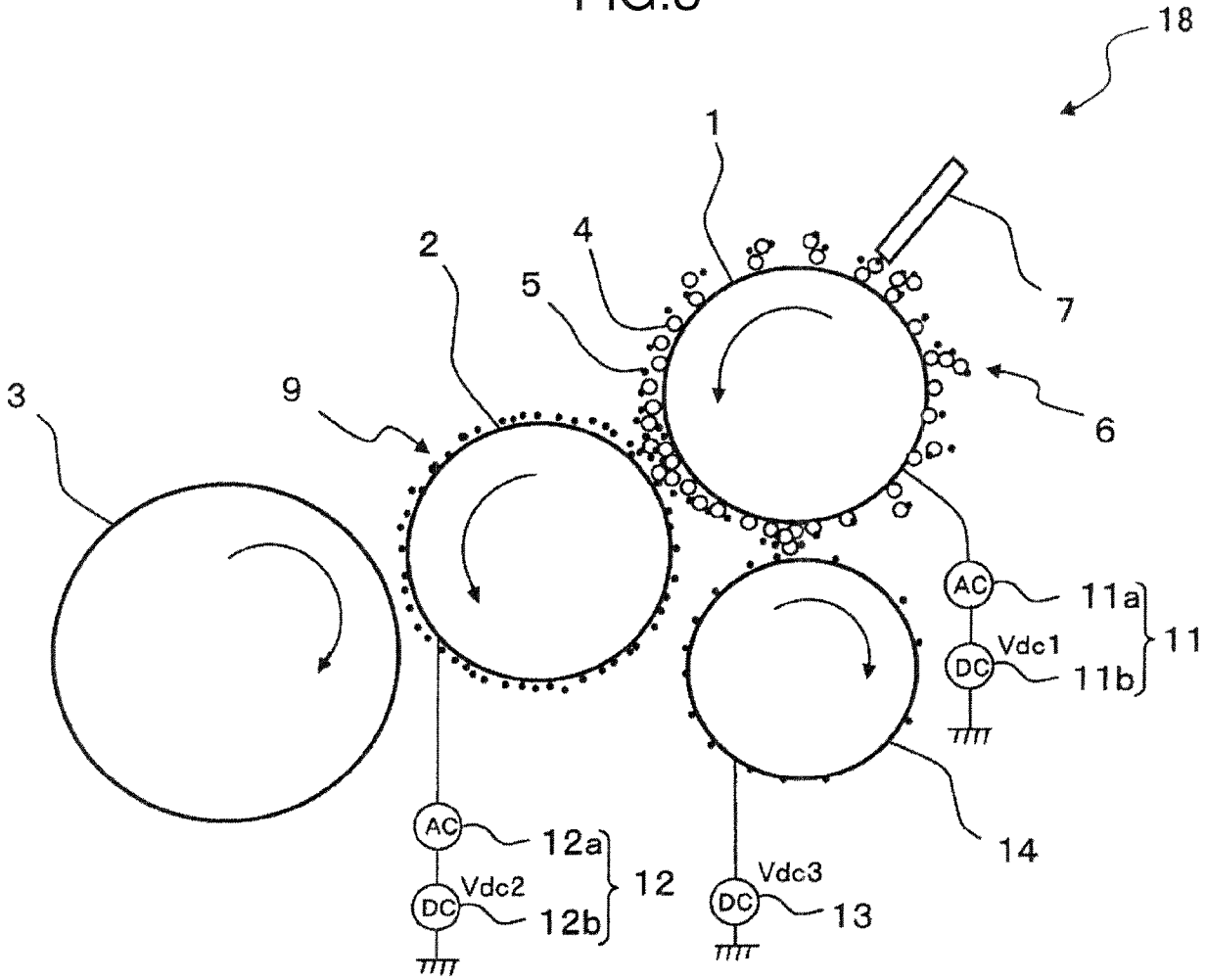
FIG. 3 is a schematic constructional diagram of the developing unit of the first embodiment of the invention.

FIG. 2 is an explanatory diagram generally showing the configuration of the image forming apparatus according to the first embodiment. For the sake of simplicity, the developing units 18A, 18B, 18C, 18D of FIG. 1 which have basically the same construction are represented by a single "developing unit 18" in FIG. 2. Similarly, the photosensitive drums 3A, 3B, 3C, 3D of FIG. 1 which have basically the same construction are represented by a single "photosensitive drum 3" in FIG. 2. FIG. 3 is a diagram showing a principal portion of the developing unit 18 provided in the image forming apparatus of FIG. 2.

The image forming apparatus of the first embodiment is based on the so-called touchdown development system in which a two-component developer containing magnetic carrier beads 4 and toner particles 5 carried by and supplied from a magnetic roller 1 forms a thin toner layer 9 on a development roller 2 and part of the thin toner layer 9 on the development roller 2 is transferred to a photosensitive drum (latent image carrying member) 3 to develop an electrostatic latent image formed thereon. As shown in FIG. 2, the image forming apparatus includes a charging unit 8, an exposure unit 16, the developing unit 18, a primary transfer roller 22, the secondary transfer roller 25, the fixing roller 26 and a cleaning unit 24 which are arranged around the photosensitive drum 3 on which the electrostatic latent image is formed.

The image forming apparatus performs image forming operation in the below-described fashion. The charging unit 8 uniformly charges an outer surface of the photosensitive drum 3 and the exposure unit 16 exposes the charged outer surface of the photosensitive drum 3 to form an electrostatic latent image thereon. The electrostatic latent image is developed into a visible toner image as the toner particles 5 supplied from the developing unit 18 adhere to an area of the electrostatic latent image on the photosensitive drum 3. Then, the primary transfer roller 22 transfers the toner image from the photosensitive drum 3 onto the intermediate transfer belt 20 and the secondary transfer roller 25 transfers the toner image from the intermediate transfer belt 20 to the printing sheet as mentioned above. The cleaning unit 24 removes residual toner particles 5 which are left unused for development from the surface of the photosensitive drum 3.

The photosensitive drum 3 may employ an inorganic photoreceptor, such as selenium or amorphous silicon, or an organic photoreceptor using an organic photoconductor (OPC) including a single or laminated photosensitive layer containing a charge generation material, a charge transport material and a binder resin, for example, formed on an electrically conductive base. The charging unit 8 may be a scorotron charger, a charging roller or a charging brush, for example. The exposure unit 16 may be a type employing a light emitting diode (LED) array or a semiconductor laser, for example, as an exposing light source. The cleaning unit 24 may be a doctor-blade-type cleaning device, for example. All these examples of the photosensitive drum 3, the charging unit 8, the exposure unit 16 and the cleaning unit 24 are conventional.

The developing unit 18 includes the magnetic roller (two-component developer carrying member) 1, the development roller (toner carrying member) 2, a restricting blade 7, a toner collecting roller 14, a first agitating screw 40 and a second agitating screw 44 which are together disposed in a housing 46.

The magnetic roller 1 is a sleevelike roller of which outer peripheral part rotates with a plurality of magnetic elements (first magnetic elements) fixedly arranged inside. The magnetic roller 1 magnetically holds on a peripheral surface thereof the two-component developer containing the magnetic carrier beads 4 and the toner particles 5 with the aid of the built-in magnetic elements.

The development roller 2 is also a sleevelike roller of which outer peripheral part rotates with magnetic elements fixedly arranged inside in a heteropolar configuration with respect to the magnetic roller 1. The development roller 2 carries on a peripheral surface thereof the thin toner layer 9 formed of the toner particles 5 supplied from the magnetic roller 1.

The restricting blade 7 serves to maintain a magnetic brush 6 (refer to FIG. 3) formed on the magnetic roller 1 at a specified height. The magnetic brush 6 is created by a magnetic field formed by a magnetic force produced by oppositely directed magnetic poles of the magnetic roller 1 and the development roller 2.

The toner collecting roller 14 is a roller for collecting the toner particles 5 scattered and suspended in the vicinity of the magnetic roller 1 and the development roller 2. The toner collecting roller 14 will be later described in detail.

The first agitating screw 40 and the second agitating screw 44 stir up and transport the toner particles 5 supplied from a toner container (not shown) together with the carrier beads 4 while electrically charging the toner particles 5.

The housing 46 is an enclosure for rotatably supporting the magnetic roller 1, the development roller 2, the toner collecting roller 14, the first agitating screw 40 and the second agitating screw 44 on the inside. The housing 46 has a toner inlet (not shown) through which the toner particles 5 are supplied from the aforementioned toner container, a two-component developer storage space 45 for storing the two-component developer and an opening disposed face to face with the photosensitive drum 3.

Inside the housing 46, there is provided a partition 42 which separates the first agitating screw 40 and the second agitating screw 44 from each other. Internal spaces of the housing 46 separated by the partition 42 are interconnected by two connecting channels at opposite ends of the partition 42. The two-component developer is transferred from the side of the first agitating screw 40 to the side of the second agitating screw 44 through one of the connecting channels and part of the two-component developer transported by the second agitating screw 44 is supplied to the magnetic roller 1. The remaining part of the two-component developer which has not been supplied to the magnetic roller 1 is returned to the side of the first agitating screw 40 through the other connecting channel. The two-component developer is caused to circulate in the two-component developer storage space 45 by the first agitating screw 40 and the second agitating screw 44 in this manner.

As shown in FIG. 3, the developing unit 18 is provided with a first development bias applicator 11 and a second development bias applicator 12 (together constituting a first voltage applicator) for applying development biases as well as a collection bias applicator 13 (second voltage applicator) for applying a bias for collecting the toner particles. Voltage values of these biases are controlled by an unillustrated controller.

The first development bias applicator 11 includes an alternating current (AC) bias voltage source 11*a* and a direct current (DC) bias voltage source 11*b* for supplying respectively an AC bias voltage and a DC bias voltage Vdc1 which are superimposed on each other to produce an AC/DC-combined bias voltage applied to the magnetic roller 1. Similarly, the second development bias applicator 12 includes an AC bias voltage source 12*a* and a DC bias voltage source 12*b* for supplying respectively an AC bias voltage and a DC bias voltage Vdc2 which are superimposed on each other to produce an AC/DC-combined bias voltage applied to the development roller 2. The collection bias applicator 13 applies a DC bias voltage Vdc3 to the toner collecting roller 14.

The aforementioned scattered toner particles are now described in detail. When the two-component developer adhering mainly to the magnetic roller 1 is returned to the two-component developer storage space 45, the magnetic brush 6 is compressed so that air masses held within the magnetic brush 6 can not enter the two-component developer storage space 45 but are caused to bounce back therefrom. Consequently, the toner particles 5 spew out from a two-component developer collecting part (designated by the numeral 43 in FIG. 2) together with air, thus producing the scattered toner particles.

In the touchdown development system, the magnetic roller 1 supplies the toner particles 5 to the development roller 2 in around an area where the magnetic roller 1 and the development roller 2 are closest to each other to form the thin toner layer 9 on the development roller 2 and the toner particles 5 left unused for development on the development roller 2 are scraped off therefrom and collected for reuse. The unused toner particles 5 left on the development roller 2 have low adhesion to the carrier beads 4 compared to adhesion between the toner particles 5 and the carrier beads 4 in the two-component developer during a process of forming the thin toner layer 9. In addition, since toner concentration in the two-component developer for the touchdown development system is made higher than that for an ordinary two-component developing system, the two-component developer used for touchdown development has low fluidity and, thus, it is even more difficult for the air masses held within the magnetic brush 6 to enter the two-component developer storage space 45. Therefore, toner scattering is likely to occur in the touchdown development system.

Furthermore, as process line speed increases (the photosensitive drum 3 is driven at a surface turning speed of 180 mm/sec or higher), it is needed to supply an adequate amount of toner particles 5 necessary for developing a larger number of electrostatic latent images to the development roller 2 in a short time. Since the period of time used for forming the thin toner layer 9 must be made shorter as the process line speed increases, there arises the need to take measures to increase the toner concentration in the two-component developer, for instance.

For reasons stated above, the two-component developer collected and returned to the two-component developer storage space 45 after formation of the thin toner layer 9 has a higher toner concentration when the process line speed is high compared to a case where the process line speed is low. Moreover, since the period of time available for scraping off the unused toner particles 5 from the development roller 2 decreases and the toner concentration in the two-component developer collected and returned to the two-component developer storage space 45 is high at increased process line speeds, it becomes more difficult to scrape off the residual toner particles 5 from the development roller 2. Additionally, toner scattering is more likely to occur and the scattered toner particles 5 may adhere to the development roller 2 at increased process line speeds, resulting in increases in the amounts of the collected toner particles 5 and the scattered toner particles 5. The scattered toner particles 5 can cause various kinds of image forming failures and malfunctions and, in particular, adhere to the outer surface of the development roller 2, producing an increased tendency for the ghost phenomenon to occur due to inadequate removal of the residual toner particles 5.

Mentioned above are factors which will hinder successful image forming operation. Under such circumstances, the image forming apparatus of the present embodiment is provided with the toner collecting roller 14 at an appropriate location in the housing 46 to solve the aforementioned problem. The toner collecting roller 14 is now described in detail.

The toner collecting roller 14 serves to collect the scattered toner particles 5 and return the same to the magnetic roller 1. In a configuration including the magnetic roller 1, the development roller 2, the photosensitive drum 3, the first agitating screw 40 and the second agitating screw 44, the toner collecting roller 14 is disposed to face the magnetic roller 1, as if closing an opening between the magnetic roller 1 and an inside wall 461 of the housing 46, at a location downstream of the area where the magnetic roller 1 and the development roller 2 are closest to each other with respect to a rotating direction (indicated by an arrow) of the magnetic roller 1 as shown in FIGS. 2 and 3.

This configuration enables the toner collecting roller 14 to collect the toner particles 5 scattered and suspended in the vicinity of the magnetic roller 1 and the development roller 2 as well as the toner particles 5 which are going to flow through a clearance beneath the magnetic roller 1 in an arrow direction A shown in FIG. 2 and scatter inside the image forming apparatus by causing these toner particles 5 to adhere to an outer surface of the toner collecting roller 14 by intermolecular attraction and electrostatic attraction, for instance.

As the toner collecting roller 14 rotates, the scattered toner particles 5 collected by the toner collecting roller 14 and adhering to the outer surface thereof are scraped off as a result of contact with the magnetic brush 6 formed on the magnetic roller 1 and returned thereto.

While the magnetic roller 1 and the toner collecting roller 14 may be driven to rotate in such a manner that closest facing parts of the two rollers 1, 14 move in the same direction (co-rotation) or in opposite directions (counter-rotation), the two rollers 1, 14 should preferably be driven to produce co-rotation. If the two rollers 1, 14 are in a co-rotation configuration, the toner particles 5 on the surface of the toner collecting roller 14 can be retrieved by the magnetic roller 1 quickly and easily with a reduced stress on the collected toner particles 5. This serves to suppress deterioration of the collected toner particles 5.

Surface turning speed of the toner collecting roller 14 should be 10 to 100 mm/sec, preferably 20 to 70 mm/sec. At surface turning speeds of the toner collecting roller 14 below 10 mm/sec, rotating speed of the toner collecting roller 14 is so low that the amount of the scattered toner particles 5 collected by the toner collecting roller 14 would be too small. Also, surface turning speeds of the toner collecting roller 14 exceeding 100 mm/sec are undesirable as the capability of the toner collecting roller 14 to collect the scattered toner particles 5 will decrease and the toner particles 5 adhering to the outer surface of the toner collecting roller 14 will have a tendency to scatter again when scraped by the magnetic brush 6.

A rotary sleeve of the toner collecting roller 14 may be made of a metallic material, such as aluminum or stainless steel. Taking into consideration adhesion of the scattered toner particles 5 to the toner collecting roller 14, the rotary sleeve should preferably be made of anodized aluminum having a large specific surface area. Additionally, from the viewpoint of electrostatic adhesion of the scattered toner particles 5, it is preferable to use a metallic material coated with a fluoroplastic or the like, provided that the toner particles 5 have a property of being positively charged.

The collection bias applicator 13 applies a DC bias voltage to the toner collecting roller 14 to charge the outer surface thereof to the same polarity as the polarity of static charge carried by the toner particles 5 in order that the scattered toner particles 5 collected by the toner collecting roller 14 can easily be returned to the magnetic roller 1. If the toner particles 5 used in the image forming apparatus are positively charged toner particles, for example, it is possible to decrease a potential difference between the magnetic roller 1 and the toner collecting roller 14 by applying a positive DC bias voltage (Vdc3) to the toner collecting roller 14. Consequently, an electric field intensity needed for keeping the toner particles 5 on the toner collecting roller 14 adhering thereto is lowered, so that the toner particles 5 collected by the toner collecting roller 14 can easily be scraped therefrom and efficiently returned to the magnetic roller 1.

If adhesion of the collected toner particles 5 to the toner collecting roller 14 is strong, potential of the toner collecting roller 14 may be made higher than that of the magnetic roller 1. This makes it easier for the collected toner particles 5 to move from the toner collecting roller 14 to the magnetic roller 1 at a lower potential. Preferably, the image forming apparatus should perform the aforementioned biasing operation while not performing any image forming task, for instance.

Now, development process performed by the developing unit 18 of this embodiment is described below. The magnetic brush 6 has a brushlike structure including the carrier beads 4 (magnetic particles) magnetically restrained by the magnetic elements (first magnetic elements) fixedly arranged inside the magnetic roller 1 and the charged toner particles 5 held on surfaces of the carrier beads 4. As the magnetic roller 1 rotates, part of the magnetic brush 6 held thereon is transferred to the development roller 2. If the outer surface of the magnetic roller 1 is sandblasted or grooved, for instance, it is possible to transfer part of the magnetic brush 6 to the development roller 2 more smoothly.

Referring again to FIG. 3, the AC bias voltage source 12*a* and the DC bias voltage source 12*b* together apply a development bias voltage produced by superimposing the DC bias voltage Vdc2 and the AC bias voltage to the development roller 2, whereas the AC bias voltage source 11*a* and the DC bias voltage source 11*b* together apply a development bias voltage produced by superimposing the DC bias voltage Vdc1 and the AC bias voltage to the magnetic roller 1. As the magnetic brush 6 is formed on the magnetic roller 1, the restricting blade 7 maintains the magnetic brush 6 at the specified height (layer thickness). Subsequently, a potential difference between the magnetic roller 1 and the development roller 2 causes only the charged toner particles 5 of the magnetic brush 6 carried by the magnetic roller 1 to jump onto the development roller 2 to form the thin toner layer 9 on the outer surface thereof. Then, the thin toner layer 9 on the development roller 2 is used to develop the electrostatic latent image on the photosensitive drum 3.

Each of the aforementioned DC bias voltages Vdc is an "area equalizing voltage" which varies with changes in duty ratio. The duty ratio (%) is given by equation below:

$$\text{Duty ratio (\%)}=[T1/(T1+T2)]\times 100$$

where T1 is the duration of a positive-going pulse and T2 is the duration of a negative-going pulse occurring in one cycle of a rectangular AC pulse voltage.

The aforementioned area equalizing voltage is a voltage at which areas enclosed by positive- and negative-going pulses and a line representing a reference voltage of a rectangular pulse waveform are equalized. A DC voltage may be superimposed on the area equalizing voltage when necessary, in which case the resultant DC bias voltage is given by Vdc=(DC voltage)+(area equalizing voltage). When an AC voltage is not superimposed, the DC bias voltage Vdc is simply a DC voltage.

The electrostatic latent image is formed on the photosensitive drum 3 by charging the outer surface thereof to +250 to +800 V by the charging unit 8 and then projecting light from the exposure unit 16. An exposed part of the outer surface of the photosensitive drum 3 is charged to a voltage of +70 to +220 V at full exposure if the photosensitive drum 3 is of a type employing an OPC photoreceptor, a voltage of +10 to +50 V after exposure if the photosensitive drum 3 is of a type employing an amorphous silicon photoreceptor.

Upon completion of the development process described above, a residual toner layer left on the development roller 2 reaches a closest point to the magnetic roller 1 carrying a developer layer at a location where the magnetic roller 1 and the development roller 2 face each other. The residual toner layer left on the development roller 2 is scraped off by a mechanical force exerted by the magnetic brush 6 at the closest point between the magnetic roller 1 and the development roller 2. At the same time, the toner particles 5 are supplied from the developer layer on the magnetic roller 1 to the development roller 2 due to the potential difference or an electric field between the magnetic roller 1 and the development roller 2.

During the development process, a voltage of +300 to +500 V and a voltage of +100 V should be applied to the magnetic roller 1 and the development roller 2, respectively, to produce desirable biasing conditions. While an appropriate potential difference between the magnetic roller 1 and the development roller 2 for producing the thin toner layer 9 on the development roller 2 is 200 to 400 V, the potential difference may be adjusted in consideration of a balance with the amount of electric charge imparted to the toner particles 5. It is possible to maintain a constant thickness of the thin toner layer 9 to a certain extent by using feedback control, for instance.

If the toner particles 5 are positively charged toner particles, for example, the bias voltage Vdc3 applied to the toner collecting roller 14 for toner collection should be the same as the voltage applied to the magnetic roller 1 in order that the toner particles 5 collected by the toner collecting roller 14 are smoothly returned to the magnetic roller 1. Alternatively, the toner collecting roller 14 may be charged to a higher potential than the magnetic roller 1. In this case, the potential of the toner collecting roller 14 should preferably be +50 to +200 V higher than that of the magnetic roller 1.

Preferably, the AC bias voltage applied to the magnetic roller 1 should be 0.1 to 2.0 kV in terms of peak-to-peak voltage Vp-p having a frequency of 2 to 4 kHz and a duty ratio of 60% to 80%, and the AC bias voltage applied to the development roller 2 should be 1.0 to 2.0 kV in terms of peak-to-peak voltage Vp-p having a frequency of 2 to 4 kHz and a duty ratio of 20% to 40%, wherein the AC bias voltages applied to the magnetic roller 1 and the development roller 2 have the same period but are in opposite phases. While the thin toner layer 9 is formed more instantaneously if the peak-to-peak AC bias voltages Vp-p are increased, this approach causes a reduction in leak-proof performance of the image forming apparatus and an increase in noise. A measure which may be taken to cope with these problems is to form a layer of anodized aluminum on the outer surfaces of the magnetic roller 1 and the development roller 2 to increase their dielectric properties. The frequency of the AC bias voltages may be adjusted according to the amount of electric charge imparted to the toner particles 5.

The toner particles 5 should preferably have a mean volume particle diameter of 4.0 to 7.5 μm. A mean volume particle diameter smaller than 4.0 μm causes deterioration of developability and collectibility of the toner particles 5 due to an increased influence of nonstatic adhesion thereof, whereas a mean volume particle diameter larger than 7.5 μm makes it difficult to achieve high-quality imaging with respect to surface smoothness of printed images, for instance. The amount of electric charge imparted to the toner particles 5 should preferably be about 6 to 30 μC/g. If the amount of electric charge imparted to the toner particles 5 is smaller than this level, the toner particles 5 will disperse from the magnetic brush 6 and smear surrounding areas. If the amount of electric charge imparted to the toner particles 5 is larger than this level, on the other hand, it will become difficult to form the thin toner layer 9.

The mean volume particle diameter of the toner particles 5 can be measured by the Particle Analyzer Model Multisizer III (manufactured by Beckman Coulter, Inc.) with an aperture diameter of 100 μm which provides a measuring range of 2.0 to 60 μm. Also, the amount of electric charge imparted to the toner particles 5 can be measured by the Q/M Meter Model 210HS-2B (manufactured by TREK, INC.).

The carrier beads 4 may be of a conventional type. It is preferable to use carrier beads made of ferrite cores of which surfaces are resin-coated. Also, it is preferable to use carrier beads having a mean weight particle diameter of 25 to 50 μm. A mean weight particle diameter smaller than 25 μm results in a reduction in retainability of the carrier beads 4 by a magnetic force so that jumping of the carrier beads 4 to the development roller 2 and/or the toner collecting roller 14 tends to occur, for instance. If the mean weight particle diameter of the carrier beads 4 is larger than 50 μm, on the other hand, the density of projections of the magnetic brush 6 will be inappropriate, the thin toner layer 9 will not be smoothly formed, and the collectibility of the toner particles 5 will decrease due to a small specific surface area of the carrier beads 4. Further, saturation magnetization of the carrier beads 4 should preferably be 35 to 90 emu/g. If the saturation magnetization of the carrier beads 4 is lower than 35 emu/g, significant jumping of the carrier beads 4 will occur. If the saturation magnetization of the carrier beads 4 is higher than 90 emu/g, on the other hand, the projections of the magnetic brush 6 become so sparse that the thin toner layer 9 will not be formed uniformly on the development roller 2. It is possible to measure the saturation magnetization of the carrier beads 4 by the Magnetometer Model VSM-P7 (manufactured by Toei Industry Co., Ltd.) in a magnetic field of 79.6 kA/m (1 kOe).

A gap between the magnetic roller 1 and the development roller 2 should be 200 to 600 μm, preferably 300 to 400 μm. This gap is a most important factor for ensuring instantaneous formation of the thin toner layer 9. Too wide a gap between the magnetic roller 1 and the development roller 2 causes deterioration of layer-forming efficiency, giving rise to such a problem as a development ghost. On the other hand, too narrow a gap will develop such a problem that the projections of the magnetic brush 6 which have passed through a blade gap between the magnetic roller 1 and the restricting blade 7 can not pass through the gap between the magnetic roller 1 and the development roller 2, thus disturbing the thin toner layer 9 on the development roller 2.

A gap between the magnetic roller 1 and the toner collecting roller 14 is required to permit the magnetic brush 6 to just touch the outer surface of the toner collecting roller 14 and should approximately be equal to the gap between the magnetic roller 1 and the development roller 2. This gap should be 200 to 600 μm, preferably 300 to 400 μm.

Preferably, the distance between the magnetic roller 1 and the toner collecting roller 14 is made approximately equal to the distance between the magnetic roller 1 and the development roller 2. This makes it possible to reduce stress on the toner particles 5 collected by the toner collecting roller 14, return the collected toner particles 5 back to the magnetic roller 1 and prevent the toner particles 5 scattering from around the magnetic roller 1 from going toward the development roller 2.

A more specific example of the first embodiment is described below. Needless to say, the first embodiment is not limited to the following example.

Example 1

The inventors of the present invention prepared an image forming apparatus like the one shown in FIG. 2 based on below-described specifications. Specifically, the image forming apparatus prepared as Example 1 included a developing unit in which the toner collecting roller 14 was disposed between the magnetic roller 1 and the inside wall 461 of the housing 46 downstream of the closest point between the magnetic roller 1 and the development roller 2 with respect to the rotating direction of the magnetic roller 1.

The photosensitive drum 3 was a 30-mm-diameter photosensitive drum with an amorphous silicon photoreceptor, the development roller 2 employed a 20-mm-diameter sleeve made of anodized aluminum, the magnetic roller 1 employed a 25-mm-diameter sleeve made of aluminum, and the toner collecting roller 14 employed a 16-mm-diameter sleeve made of aluminum.

The magnetic roller 1 and the toner collecting roller 14 were in a co-rotation configuration so that the closest facing parts of the two rollers 1, 14 would move in the same direction, the toner collecting roller 14 producing a surface turning speed of 30 mm/sec which equaled 0.067 times that of the magnetic roller 1. The photosensitive drum 3 was driven to produce a drum line speed of 300 mm/sec in Example 1.

The image forming apparatus thus configured was experimentally run to perform the image forming operation under the following conditions:

Photoreceptor surface potential: +310 V

Q/m of toner in developer: 20 μC/g

Toner particle diameter (mean volume particle diameter: D50): 6.7 μm

Carrier bead diameter (mean weight particle diameter: D50): 45 μm

Distance between magnetic roller and development roller: 350 μm

Distance between development roller and toner collecting roller: 1000 μm

Distance between magnetic roller and toner collecting roller: 350 μm

Voltage applied to development roller: Vdc=100 V, Vp-p=1.6 kV, frequency f=2.7 kHz, duty ratio=27%

Voltage applied to magnetic roller: Vdc=300 V, Vp-p=300 V, frequency f=2.7 kHz, duty ratio=73%

Voltage applied to toner collecting roller: Vdc=350 V, Vp-p=1.0 kV, frequency f=2.7 kHz, duty ratio=27%

Experimental results obtained under these conditions have revealed that the image forming apparatus of Example 1 could perform the image forming operation in a stable and desirable fashion while efficiently collecting the scattered toner particles 5 and suppressing deterioration of the toner particles 5.

Second Embodiment

Figure 4:
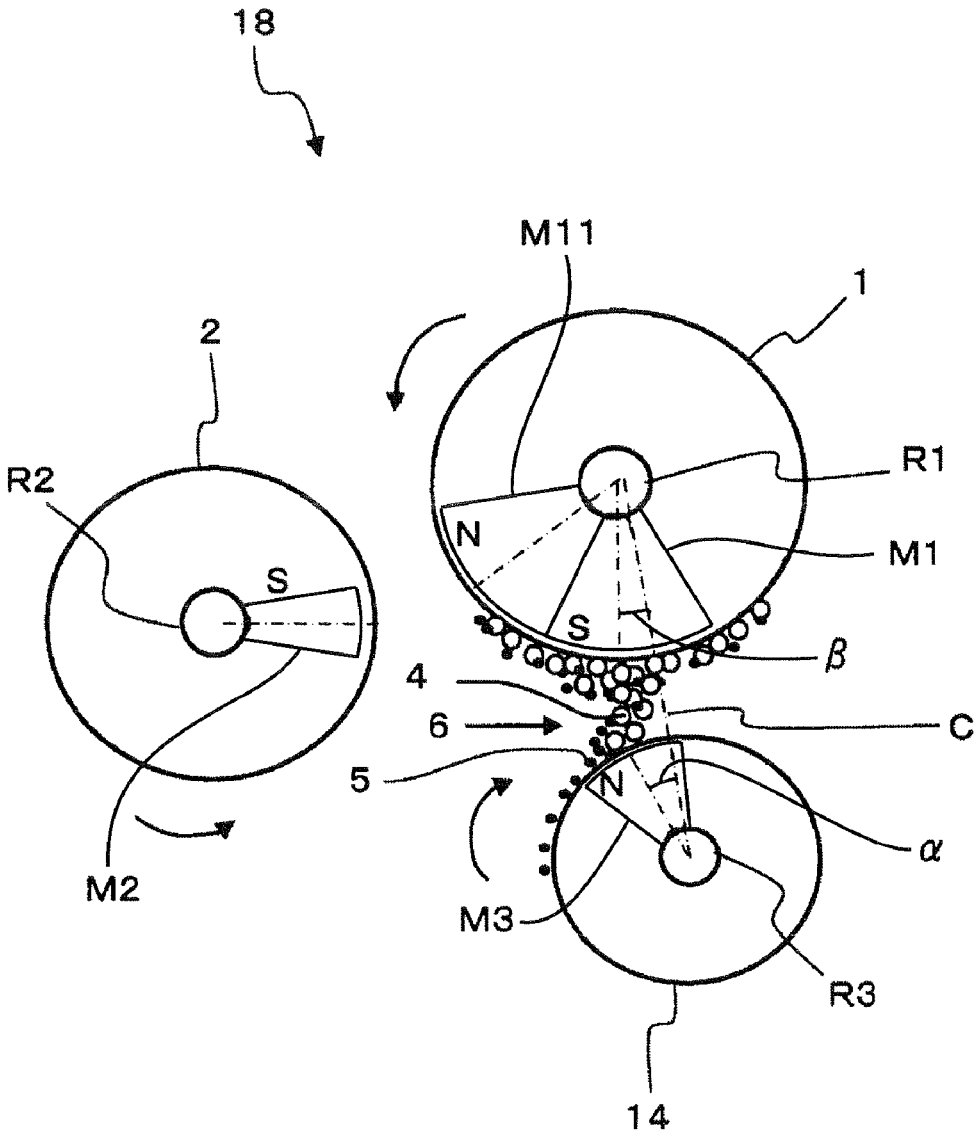
FIG. 4 is a schematic constructional diagram of the developing unit according to the second embodiment of the invention.

FIG. 4 is a schematic diagram of a developing unit 18 according to the second embodiment of the invention which is provided in the image forming apparatus of FIG. 2. The developing unit 18 of the second embodiment shown in FIG. 4 is an example in which a magnetic element M3 (second magnetic element) provided inside the toner collecting roller 14 is disposed in a heteropolar configuration with respect to a magnetic element M1 (first magnetic element) provided inside the magnetic roller 1 so that magnetic poles of opposite polarities of the magnetic elements M1 and M3 face each other.

The magnetic roller 1, the development roller 2 and the toner collecting roller 14 of the second embodiment are positioned in the same relative arrangement as those of the first embodiment. Other elements of the developing unit 18 of the second embodiment are also in the same arrangement as shown in FIGS. 1 and 2 except for arrangements of below-described magnetic elements.

The magnetic roller 1 includes a plurality of magnetic elements M1, M11 arranged fixedly on a roller shaft R1 provided in the magnetic roller 1 and a sleeve which rotates on an outer periphery of the magnetic elements M1, M11. The development roller 2 includes a magnetic element M2 arranged fixedly on a roller shaft R2 provided in the development roller 2 and a sleeve which rotates on an outer periphery of the magnetic element M2, wherein the magnetic element M2 is disposed in a heteropolar configuration with respect to the magnetic element M11 of the magnetic roller 1 so that magnetic poles of opposite polarities of the magnetic elements M2 and M11 face each other. A magnetic force produced by the oppositely directed magnetic poles of the magnetic roller 1 and the development roller 2 forms a magnetic field therebetween which produces a magnetic brush 6 on the magnetic roller 1.

The toner collecting roller 14 includes the aforementioned magnetic element M3 mounted therein and a sleeve which rotates on an outer periphery of the magnetic element M3. The magnetic element M3 is nonrotatably fixed to and supported by a roller shaft R3 provided in the toner collecting roller 14 in such a way that the magnetic element M3 inclines by a specific angle in a circumferential direction. Radially outer ends of the magnetic element M3 of the toner collecting roller 14 and the magnetic element M1 (hereinafter referred to as the retrieval pole M1 where appropriate) of the magnetic roller 1 are disposed to face each other with opposite magnetic polarities as mentioned above. In the example shown in FIG. 4, the magnetic element M3 of the toner collecting roller 14 has a north (N) pole directed radially outward while the retrieval pole M1 of the magnetic roller 1 is a south (S) pole directed radially outward.

Preferably, the center of the magnetic element M3 of the toner collecting roller 14 is offset to an upstream side along a rotating direction of the toner collecting roller 14 with respect to a straight line C connecting centers of the magnetic roller 1 and the toner collecting roller 14 as seen in cross section. As depicted in FIG. 4, an offset angle $\alpha$ to the upstream side of the magnetic element M3 of the toner collecting roller 14 is 1° to 6°, preferably approximately 5°. On the other hand, the center of the retrieval pole M1 of the magnetic roller 1 is preferably offset to an upstream side along the rotating direction of the magnetic roller 1 with respect to the aforementioned straight line C. An offset angle $\beta$ to the upstream side of the retrieval pole M1 of the magnetic roller 1 is preferably 1° to 6°, and more preferably approximately 5°. An arrangement in which the aforementioned offset angle $\alpha$ is smaller than 1° is undesirable as the carrier beads 4 might be attracted to the toner collecting roller 14. An arrangement in which the offset angle $\alpha$ is larger than 6° is also undesirable because this arrangement produces too small an attractive force for returning the toner particles 5 on the toner collecting roller 14 to the magnetic roller 1, possibly causing an inability to perform toner collection.

The magnetic roller 1 and the toner collecting roller 14 are configured such that the closest facing parts of the two rollers 1, 14 move side by side in the same direction, the toner collecting roller 14 having a lower surface turning speed than the magnetic roller 1. Specifically, the toner collecting roller 14 is driven to rotate at a surface turning speed equaling 0.01 to 0.1 times, preferably 0.03 to 0.06 times, that of the magnetic roller 1.

The magnetic element M3 may be made of any material generating a magnetic force and is not limited to a specific material. Preferably, the magnetic element M3 is made of a magnet, such as a rubber magnet for the sake of machinability. Alternatively, the magnetic element M3 may be made of a magnetic material which produces a magnetic field when placed in the vicinity of a magnet.

In the developing unit 18 of the second embodiment described above, the magnetic element M3 (N pole) of the toner collecting roller 14 is located face to face with the retrieval pole M1 (S pole) of the magnetic roller 1. As a consequence, there is formed a magnetic field and, thus, a bladelike projection of the magnetic brush 6 between the magnetic roller 1 and the toner collecting roller 14 in an area upstream of the closest facing parts of the two rollers 1, 14.

As illustrated in FIG. 4, this bladelike projection of the magnetic brush 6 formed between the magnetic roller 1 and the toner collecting roller 14 is inclined to a downstream side upward with respect to the rotating direction of the magnetic roller 1 in this embodiment, compared to a case in which both of the aforementioned offset angles α, β are made equal to 0° (α=β=0°) for zero angular offset of the magnetic elements M1 and M3. Therefore, the toner particles 5 adhering to the toner collecting roller 14 can be carried upward downstream along the rotating direction of the magnetic roller 1 more easily after being scraped off by a mechanical force exerted by the magnetic brush 6, so that the collected toner particles 5 can be efficiently retrieved by the magnetic roller 1 without depositing on the toner collecting roller 14.

In addition, formation of the aforementioned bladelike projection of the magnetic brush 6 between the magnetic roller 1 and the toner collecting roller 14 serves to block a passageway which will permit the toner particles 5 to scatter from the two-component developer collecting part 43 (see FIG. 2) of the magnetic roller 1 toward the development roller 2, so that the toner particles 5 scattering from the two-component developer collecting part 43 can be entrapped and returned to the magnetic roller 1. Furthermore, since the magnetic roller 1 and the toner collecting roller 14 are configured such that the closest facing parts of the two rollers 1, 14 move side by side in the same direction, it is possible to reduce stress on the collected toner particles 5 and prevent deterioration thereof.

The magnetic element M3 produces a radially oriented magnetic force of 30 to 70 mT, preferably 40 to 60 mT, in terms of surface flux density on the surface of the toner collecting roller 14. In this case, a surface flux density produced by the magnetic element M11 (hereinafter referred to as the main pole M11 where appropriate) is 70 to 100 mT, preferably 80 to 100 mT. The retrieval pole M1 produces a radially oriented magnetic force of 60 to 90 mT, preferably 70 to 90 mT, in terms of surface flux density on the surface of the magnetic roller 1, which is higher than the surface flux density produced by the magnetic element M3 of the toner collecting roller 14 but lower than the surface flux density produced by the main pole M11 of the magnetic roller 1. Also, the magnetic element M2 of the development roller 2 produces a radially oriented magnetic force of 20 to 60 mT, preferably 30 to 50 mT, in terms of surface flux density on the surface of the development roller 2, which is lower than the surface flux densities produced by the magnetic element M3 and the main pole M11.

Since the magnetic force produced by the magnetic element M3 of the toner collecting roller 14 is made smaller than that produced by the retrieval pole M1 of the magnetic roller 1 as mentioned above, it is possible to pull a greater part of the carrier beads 4 back toward the magnetic roller 1. Consequently, the toner particles 5 on the toner collecting roller 14 are efficiently returned back to the magnetic roller 1 and the magnetic roller 1 is not deprived of the carrier beads 4 by the toner collecting roller 14.

If the toner 5 used in the second embodiment is a positively charged toner, for example, the bias voltage Vdc3 applied to the toner collecting roller 14 for toner collection should preferably be made higher than the voltage applied to the magnetic roller 1 in order that the toner particles 5 collected by the toner collecting roller 14 are smoothly returned to the magnetic roller 1. In this case, however, the toner particles 5 might be attracted to the development roller 2 which is charged to a lower potential than the magnetic roller 1. To prevent this inconvenience, the toner collecting roller 14 should be at a potential between the potentials of the magnetic roller 1 and the development roller 2, preferably between +200 and +300 V.

As is the case with the first embodiment, the gap between the magnetic roller 1 and the development roller 2 should be 200 to 600 μm, preferably 300 to 400 μm. On the other hand, the gap between the magnetic roller 1 and the toner collecting roller 14 is required to permit the magnetic brush 6 to just touch the outer surface of the toner collecting roller 14 and should therefore be made smaller than the gap between the magnetic roller 1 and the development roller 2. Specifically, the gap between the magnetic roller 1 and the toner collecting roller 14 should be 150 to 500 μm, preferably 200 to 300 μm.

It is possible to prevent the toner particles 5 scattering from around the magnetic roller 1 from going toward the development roller 2 by making the distance between the magnetic roller 1 and the toner collecting roller 14 equal to or smaller than the distance between the magnetic roller 1 and the development roller 2. Leaks can occur when the gap between the magnetic roller 1 and the toner collecting roller 14 is reduced. To prevent such leaks, it will be necessary to form a layer of anodized aluminum on the outer surface of the toner collecting roller 14 to increase dielectric properties and resistance thereof, for instance. In this case, the outer surface of the toner collecting roller 14 should preferably have an electrical resistivity of $10^7$ to $10^{12}$ ohm-meters.

More specific examples of the second embodiment are described below. Needless to say, the second embodiment is not limited to the following examples.

Example 2

The inventors prepared an image forming apparatus like the one shown in FIG. 2 based on below-described specifications. The photosensitive drum 3 was a 30-mm-diameter photosensitive drum with an amorphous silicon photoreceptor, the development roller 2 employed a 20-mm-diameter sleeve made of anodized aluminum, the magnetic roller 1 employed a 25-mm-diameter sleeve made of aluminum, and the toner collecting roller 14 employed a 16-mm-diameter sleeve made of aluminum. The photosensitive drum 3 was driven to produce a drum line speed of 300 mm/sec in Example 2.

The offset angles α, β to the upstream side of the magnetic element M3 of the toner collecting roller 14 and the retrieval pole M1 of the magnetic roller 1 were both set to 5° (α=β=5°). The magnetic element M3 was made of a rubber magnet which produced a radially oriented magnetic force of 55 mT on the surface of the toner collecting roller 14 (Example 2-1). Also, the main pole M11 and the retrieval pole M1 of the magnetic roller 1 produced radially oriented magnetic forces of 90 mT and 80 mT on the surface of the magnetic roller 1, respectively. The Tesla Meter Model GX-100 (manufactured by Nihon Denji Sokki Co., Ltd.) was used for measuring the magnetic forces.

The development roller 2 was driven to rotate at a surface turning speed of 450 mm/sec which was 1.5 times that of the photosensitive drum 3. The magnetic roller 1 was driven to rotate at a surface turning speed of 675 mm/sec which was 1.5 times that of the development roller 2. The toner collecting roller 14 was driven to rotate at a surface turning speed of 30 mm/sec.

The image forming apparatus thus configured was experimentally run to perform the image forming operation under the following conditions:

Photoreceptor surface potential: +310 V

Q/m of toner (positively charged) in developer: 20 μC/g

Toner particle diameter (mean volume particle diameter): 6.7 μm

Carrier bead diameter (mean weight particle diameter): 45 μm

Distance between magnetic roller and development roller: 350 μm

Distance between magnetic roller and toner collecting roller: 250 μm

Voltage applied to development roller: Vdc2=100 V, Vp-p=1.6 kV, frequency f=2.7 kHz, duty ratio=27%

Voltage applied to magnetic roller: Vdc1=300 V, Vp-p=300 V (same period but in opposite phase with voltage applied to development roller), frequency f=2.7 kHz, duty ratio=73%

Voltage applied to toner collecting roller: Vdc3=200 V (DC voltage only)

Examples 2-2 to 2-12, Comparative Examples 2-1, 2-2

The inventors further prepared image forming apparatuses as Examples 2-2 to 2-12 of the invention and Comparative Examples 2-1 and 2-2 configured to the same specifications as Example 2-1 discussed above, except that the toner collecting roller 14 was provided, or not provided, and the magnetic element M3 was mounted at different offset angles α and produced different magnetic forces depending on the Examples as shown in Table 1.

To evaluate capabilities of the image forming apparatuses of these Examples to prevent toner scattering, the inventors conducted a series of experiments. For the purpose these experiments, the developing unit 18 was modified such that a member designated by the numeral 47 in FIG. 2, which was made of the same acrylonitrile-butadiene-styrene (ABS) resin as the housing 46, could be detached from the developing unit 18. An evaluation was made by comparing the amounts of the toner particles 5 adhering to an inside surface of the member 47 per unit area when the image forming apparatuses just output a 1000th copy of an original having a 6% coverage rate. Evaluated characteristics also included the tendency of the toner collecting roller 14 to attract the carrier beads 4.

The toner particles 5 adhering to the member 47 were sucked and the weight of the sucked toner particles 5 was measured by using the Q/M Meter Model 210PS (manufactured by TREK, INC.). Measurement results are shown in Table 1.

Results of evaluation of the capabilities of the image forming apparatuses of the individual Examples to prevent toner scattering are shown in Table 1 using the following symbols:

◎: Less than 0.06 mg/cm$^2$

Δ: 0.06 mg/cm$^2$ or above but less than 0.09 mg/cm$^2$ x: 0.09 mg/cm$^2$ or above The tendency of the toner collecting roller 14 to attract the carrier beads 4 was determined by visually inspecting whether any carrier beads 4 were present on toner collecting roller 14. Results of evaluation of the carrier-attracting tendency of the toner collecting roller 14 are shown in Table 1 using the following symbols:

○: Carrier-adhesion is not observed even when a magnet is brought close to the toner collecting roller 14.

Δ: Slight carrier-adhesion is observed when a magnet is brought close to the toner collecting roller 14.

▲: Slight carrier-adhesion is observed even without the presence of a magnet.

TABLE 1

| | TONER COLLECTING ROLLER | | | MAGNETIC FORCE OF MAGNETIC | | | |
|---|---|---|---|---|---|---|---|
| | PROVIDED? | MAGNET MOUNTING ANGLE (deg.) | MAGNETIC FORCE OF MAGNET (mT) | ROLLER RETRIEVAL POLE (mT) | SCATTERED TONER (mg/cm$^2$) | | ATTRACTED CARRIER |
| EXAMPLE 2-1 | YES | 5 | 55 | 80 | 0.03 | ○ | ○ |
| EXAMPLE 2-2 | YES | 1 | 55 | 80 | 0.01 | ○ | ○ |
| EXAMPLE 2-3 | YES | 6 | 55 | 80 | 0.04 | ○ | ○ |
| EXAMPLE 2-4 | YES | 0 | 55 | 80 | 0.01 | ○ | Δ |
| EXAMPLE 2-5 | YES | 7 | 55 | 80 | 0.06 | Δ | ○ |
| EXAMPLE 2-6 | YES | 0 | 85 | 80 | 0.01 | ○ | ▲ |
| EXAMPLE 2-7 | YES | 6 | 30 | 80 | 0.05 | ○ | ○ |
| EXAMPLE 2-8 | YES | 6 | 40 | 80 | 0.04 | ○ | ○ |
| EXAMPLE 2-9 | YES | 5 | 60 | 80 | 0.03 | ○ | ○ |
| EXAMPLE 2-10 | YES | 5 | 70 | 80 | 0.01 | ○ | ○ |
| EXAMPLE 2-11 | YES | 6 | 25 | 80 | 0.06 | Δ | ○ |
| EXAMPLE 2-12 | YES | 5 | 75 | 80 | 0.01 | ○ | Δ |
| COMPARATIVE EXAMPLE 2-1 | YES | NIL | — | 80 | 0.1 | X | — |
| COMPARATIVE EXAMPLE 2-2 | NO | — | — | 80 | 0.5 | X | — |

When the image forming apparatus was provided with the toner collecting roller 14 for collecting the scattered toner particles 5 disposed face to face with the magnetic roller 1 and the magnetic element M3 disposed inside the toner collecting roller 14, the amount of the scattered toner particles 5 was 0.01 to 0.06 mg/cm$^2$ as shown in Table 1. The image forming apparatuses of the aforementioned Examples 2-1 to 2-12 exhibited capabilities to successfully prevent toner scattering and suppress the carrier-attracting tendency of the toner collecting roller 14.

In contrast, when the magnetic element M3 was not provided, the amount of the scattered toner particles 5 increased to 0.1 mg/cm$^2$ (Comparative Example 2-1), and when the toner collecting roller 14 was not provided, the amount of the scattered toner particles 5 increased to 0.5 mg/cm$^2$ (Comparative Example 2-2), thus showing an increased toner-scattering tendency of both Comparative Examples 2-1, 2-2.

Third Embodiment

The third embodiment is a variation of the second embodiment. Specifically, an image forming apparatus of the third embodiment is configured such that the magnetic force acting between the magnetic roller 1 and the toner collecting roller 14 is made larger than that acting between the magnetic roller 1 and the development roller 2. The image forming apparatus of the third embodiment has otherwise the same configuration as the image forming apparatus of the second embodiment.

A reason why the magnetic force acting between the magnetic roller 1 and the toner collecting roller 14 is made larger than that acting between the magnetic roller 1 and the development roller 2 is as follows. The magnetic roller 1 and the development roller 2 are in a counter-rotation configuration so that closest facing parts of the two rollers 1, 2 move in opposite directions, whereas the magnetic roller 1 and the toner collecting roller 14 are in a co-rotation configuration so that the closest facing parts of the two rollers 1, 14 move in the same direction as shown in FIG. 3. If the development roller 2 and the toner collecting roller 14 rotate at the same surface turning speed and have the same surface properties (e.g., surface roughness), for example, the development roller 2 can collect the toner particles 5 adhering to individual projections of the magnetic brush 6 on the magnetic roller 1 more easily than the toner collecting roller 14. This situation remains the same even when the toner collecting roller 14 is not rotating.

In this embodiment, arithmetic mean surface roughness Ra of the toner collecting roller 14 is made higher than that of the development roller 2 to enhance the capability of the toner collecting roller 14 to collect the scattered toner particles 5 as will be later described. Accordingly, the development roller 2 can collect the toner particles 5 adhering to the individual projections of the magnetic brush 6 on the magnetic roller 1 even more easily than the toner collecting roller 14, and it is difficult to scrape off the toner particles 5 from the toner collecting roller 14.

Under such circumstances, the magnetic force acting between the magnetic roller 1 and the toner collecting roller 14 is made larger than that acting between the magnetic roller 1 and the development roller 2 to thereby enhance a magnetic retaining force between the magnetic roller 1 and the toner collecting roller 14. The bladelike projection of the magnetic brush 6 consequently formed between the magnetic roller 1 and the toner collecting roller 14 serves to prevent the scattered toner particles 5 from flowing through the opening between the magnetic roller 1 and the inside wall 461 of the housing 46 in the arrow direction A shown in FIG. 2, securely entrap and collect the scattered toner particles 5 and return the same to the two-component developer storage space 45.

The magnetic force produced between the magnetic roller 1 and the toner collecting roller 14 should preferably be 100 to 160 mT. In case that the saturation magnetization of the carrier beads 4 is low, if this magnetic force is smaller than 100 mT, a toner-scraping effect may decrease, and if the magnetic force is higher than 160 mT, the carrier-attracting tendency of the toner collecting roller 14 may potentially increase. If this magnetic force exceeds 160 mT when the saturation magnetization of the carrier beads 4 is high, on the other hand, strong developer bridging can occur, potentially causing accelerated deterioration of the toner particles 5.

The magnetic force produced by the magnetic element M3 of the toner collecting roller 14 should preferably be made larger than the magnetic force produced by the magnetic element M2 of the development roller 2. This makes it possible to make the magnetic force produced between the magnetic roller 1 and the toner collecting roller 14 larger than that produced between the magnetic roller 1 and the development roller 2. Also, the magnetic force produced by the magnetic element M3 should preferably be made smaller than the magnetic force produced by the retrieval pole M1 of the magnetic roller 1. This enables the retrieval pole M1 to retrieve a greater part of the carrier beads 4 back to the magnetic roller 1 by magnetic attraction, so that the toner particles 5 on the toner collecting roller 14 are efficiently returned to the magnetic roller 1 and the magnetic roller 1 will not be deprived of the carrier beads 4 by the toner collecting roller 14.

The arithmetic mean surface roughness Ra of the toner collecting roller 14 should be 0.505 to 3.0 μm, preferably 0.75 to 2.0 μm, which is higher than that of the development roller 2. If the arithmetic mean surface roughness Ra of the toner collecting roller 14 is made lower than that of the development roller 2, the toner collecting roller 14 will have less capability to collect the scattered toner particles 5, so that part of the scattered toner particles 5 will be captured by the development roller 2, resulting in a reduction in toner-collecting capability of the toner collecting roller 14. Also, if the arithmetic mean surface roughness Ra of the toner collecting roller 14 is lower than 0.505 μm, the toner collecting roller 14 will not have an adequate capability to collect and retain the scattered toner particles 5. If the arithmetic mean surface roughness Ra of the toner collecting roller 14 is higher than 3.0 μm, the toner particles 5 collected by the toner collecting roller 14 will not be adequately taken up by the magnetic brush 6 but deposit on the toner collecting roller 14. On the other hand, the arithmetic mean surface roughness Ra of the development roller 2 should preferably be 0.5 to 1.0 μm.

Additionally, the arithmetic mean surface roughness Ra of the toner collecting roller 14 should preferably be 1.01 to 3.0 times that of the development roller 2. If the arithmetic mean surface roughness Ra of the toner collecting roller 14 falls within this range, the toner collecting roller 14 will attain a greater capability to collect the scattered toner particles 5 and retain the same with increased adhesion.

A more specific example of the third embodiment is described below.

Example 3

The inventors prepared image forming apparatuses like the one shown in FIG. 2 based on below-described specifications. Specifically, the photosensitive drum 3, the development roller 2, the magnetic roller 1 and the toner collecting roller 14 employed sleeves made of aluminum, measuring 30 mm, 20 mm, 25 mm and 10 mm in diameter, respectively, and were driven to rotate at the following surface turning speeds:

Photosensitive drum 3: 300 mm/sec
Development roller 2: 450 mm/sec
Magnetic roller 1: 675 mm/sec
Toner collecting roller 14: 30 mm/sec The magnetic element M3, if provided in the toner collecting roller 14, was mounted with an offset angle α equal to 5°, and the retrieval pole M1 of the magnetic roller 1 was mounted with an offset angle β equal to 5° (α=β=5°). The magnetic elements M2, M11, M1, M3 produced radially oriented magnetic forces shown below on the surfaces of the respective rollers 2, 1, 14:

Magnetic element M2 (S pole) of development roller 2: 40 mT
Main pole M11 (N pole) of magnetic roller 1: 90 mT
Retrieval pole M1 (S pole) of magnetic roller 1: 80 mT
Magnetic element M3 (N pole) of toner collecting roller 14: 55 mT The arithmetic mean surface roughness Ra of the toner collecting roller 14 and that of the development roller 2 were varied to produce different surface roughness combinations as shown in Examples 3-1 to 3-6 and Comparative Examples 3-1 and 3-2 in Table 2.

The Tesla Meter Model GX-100 (manufactured by Nihon Denji Sokki Co., Ltd.) was used for measuring the magnetic forces on the surfaces of the magnetic roller 1 and the toner collecting roller 14. Also, the Surface Roughness Meter Model SURFCOM1500 DX (manufactured by Tokyo Seimitsu Co., Ltd.) was used for measuring the arithmetic mean surface roughness Ra under conditions shown below:

Calculating method: Japanese Industrial Standard JIS-1994

Type of measurement: Measurement of surface roughness

Measurement length: 4.0 mm

Cutoff wavelength: 0.8 mm

Measuring speed: 0.3 mm/sec

Length for evaluation: 4.0 mm

The image forming apparatuses of the Examples and Comparative Examples thus configured were experimentally run to perform the image forming operation under the following conditions:

Photoreceptor surface potential: +310 V

Q/m of toner in developer: 18 μC/g

Toner particle diameter (mean volume particle diameter): 6.5 μm

Carrier bead diameter (mean weight particle diameter): 50 μm

Distance between magnetic roller and development roller: 350 μm

Distance between magnetic roller and toner collecting roller: 250 μm

Voltage applied to development roller: Vdc2=100 V, Vp-p=1.6 kV, frequency f=2.7 kHz, duty ratio=27%

Voltage applied to magnetic roller: Vdc1=300 V, Vp-p=300 V (same period but in opposite phase with voltage applied to development roller), frequency f=2.7 kHz, duty ratio=73%

Voltage applied to toner collecting roller: Vdc3=200 V (DC Voltage Only)

Capabilities of the image forming apparatuses of the aforementioned Examples to collect and return the scattered toner particles 5 to the two-component developer storage space 45 by the toner collecting roller 14 and prevent toner scattering were evaluated using the below-described evaluation method and criteria.

To evaluate the capabilities to collect and return the scattered toner particles 5 entrapped by and adhering to the toner collecting roller 14 back to the two-component developer storage space 45 with the aid of the magnetic brush 6, the inventors conducted a series of experiments. An evaluation was made by measuring the amounts M (mg/cm$^2$) of the toner particles 5 adhering to the toner collecting roller 14 when the image forming apparatuses just output a 50th copy of an original having a 6% optical density at approximately a 7% toner concentration in the two-component developer. The amounts M (mg/cm$^2$) of the collected toner particles 5 adhering to the toner collecting roller 14 and the amounts of the toner particles 5 scattered and adhering to the member 47 were measured by using the Q/M Meter Model 210PS (manufactured by TREK, INC.). Results of evaluation are shown in Table 2 using the following symbols:

◎: M≦0.01

○: 0.01<M≦0.05

Δ: 0.05<M≦0.1 x: 0.1<M

To evaluate the capabilities of the image forming apparatuses of the aforementioned Examples to prevent toner scattering, the developing unit 18 was modified such that the member 47 shown in FIG. 2, which was made of the same ABS resin as the housing 46, could be detached from the developing unit 18. An evaluation was made by comparing the amounts of the toner particles 5 adhering to the inside surface of the member 47 per unit area when the image forming apparatuses just output a 1000th copy of an original having a 6% coverage rate. Results of evaluation are shown in Table 2 using the following symbols:

◎: Less than 0.05 mg/cm$^2$

○: 0.05 mg/cm$^2$ or above but less than 0.1 mg/cm$^2$

Δ: 0.1 mg/cm$^2$ or above but less than 0.15 mg/cm$^2$ x: 0.15 mg/cm$^2$ or above

TABLE 2

| | MAGNETIC FORCE OF MAGNET (N POLE) IN TONER COLLECTING ROLLER (mT) | MAGNETIC FORCE BETWEEN FACING MAGNETS IN TONER COLLECTING AND MAGNETIC ROLLERS[1)] (mT) | MAGNETIC FORCE BETWEEN FACING MAGNETS IN DEVELOPMENT AND MAGNETIC ROLLERS[2)] (mT) | SURFACE ROUGHNESS Ra OF TONER COLLECTING ROLLER (μm) | SURFACE ROUGHNESS Ra OF DEVELOPMENT ROLLER (μm) | RESIDUAL TONER ON TONER COLLECTING ROLLER (mg/cm$^2$) | | SCATTERED TONER (mg/cm$^2$) | |
|---|---|---|---|---|---|---|---|---|---|
| EXAMPLE 3-1 | 55 | 135 | 130 | 1.5 | 0.5 | 0.023 | ○ | 0.049 | ◎ |
| EXAMPLE 3-2 | 70 | 150 | 130 | 1.5 | 0.5 | 0.008 | ◎ | 0.048 | ◎ |
| EXAMPLE 3-3 | 51 | 131 | 130 | 3.0 | 1.0 | 0.031 | ○ | 0.081 | ○ |
| EXAMPLE 3-4 | 55 | 135 | 130 | 0.505 | 0.5 | 0.012 | ○ | 0.085 | ○ |
| EXAMPLE 3-5 | 55 | 135 | 130 | 3.0 | 1.0 | 0.047 | ○ | 0.075 | ○ |
| EXAMPLE 3-6 | 55 | 135 | 130 | 0.5 | 0.5 | 0.010 | ◎ | 0.115 | Δ |
| EXAMPLE 3-7 | 55 | 135 | 130 | 3.3 | 1.0 | 0.059 | Δ | 0.078 | ○ |
| COMPARATIVE EXAMPLE 3-1 | 45 | 125 | 130 | 0.5 | 0.5 | 0.075 | Δ | 0.153 | X |
| COMPARATIVE EXAMPLE 3-2 | 0 | 80 | 130 | 1.5 | 0.5 | 0.266 | X | 0.174 | X |

[1)]MAGNETIC ROLLER RETRIEVAL POLE M1 (S POLE) 80 mT

[2)]DEVELOPMENT ROLLER MAGNET (S POLE) 40 mT

MAGNETIC ROLLER MAIN POLE (N POLE) 90 mT

As shown in Table 2, the image forming apparatuses of the aforementioned Examples 3-1 to 3-6 exhibited capabilities to successfully collect and return the toner particles 5 adhering to the toner collecting roller 14 back to the two-component developer storage space 45 with the aid of the magnetic brush 6. In addition, the image forming apparatuses of these Examples exhibited capabilities to successfully collect the scattered toner particles 5 and prevent toner scattering.

On the other hand, the image forming apparatus of Comparative Example 3-1 was not able to adequately collect and return the toner particles 5 adhering to the toner collecting roller 14 back to the two-component developer storage space 45 with the magnetic brush 6 and produced significant toner scattering as compared to the image forming apparatuses of Examples 3-1 to 3-6 in which the magnetic force produced between the magnetic roller 1 and the toner collecting roller 14 was smaller than the magnetic force produced between the magnetic roller 1 and the development roller 2. Furthermore, the image forming apparatus of Comparative Example 3-2, in which the magnetic element M3 was not mounted in the toner collecting roller 14, the magnetic brush 6 could not adequately collect the toner particles 5 adhering to the toner collecting roller 14 and the toner collecting roller 14 could not adequately collect the scattered toner particles 5.

Fourth Embodiment

The fourth embodiment is also a variation of the second embodiment. Specifically, an image forming apparatus of the fourth embodiment is configured such that the magnetic element M3 (second magnetic element) of the toner collecting roller 14 is disposed along an axial direction thereof and magnetic forces produced by the magnetic element M3 at opposite axial end portions of the toner collecting roller 14 are made larger than a magnetic force produced by the magnetic element M3 at a middle portion of the toner collecting roller 14. The image forming apparatus of the fourth embodiment has otherwise the same configuration as the image forming apparatus of the second embodiment.

Figure 5A:
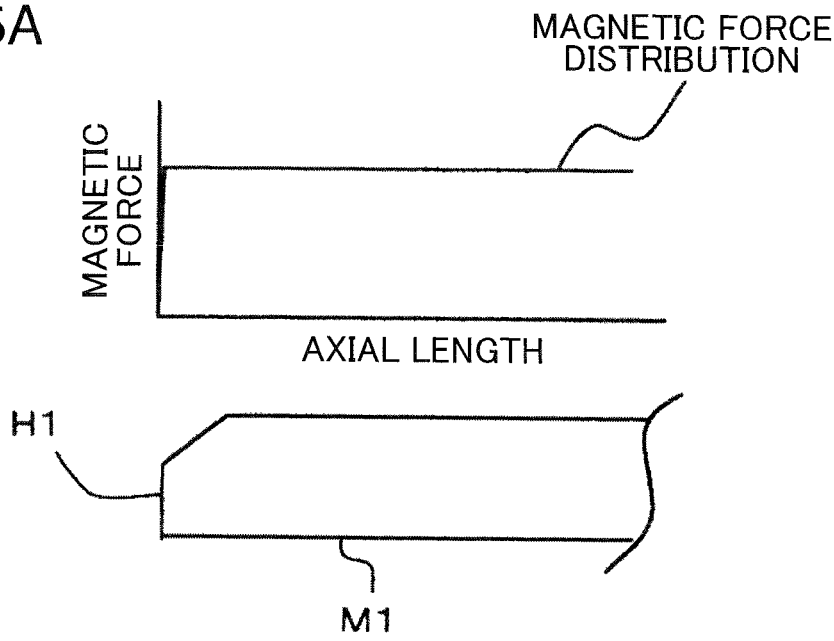
FIGS. 5A and 5B are graphical representations of how magnetic forces are distributed along longitudinal end portions of a magnetic roller and a toner collecting roller, respectively, in the developing unit according to the fourth embodiment of the invention.

In the image forming apparatus of the fourth embodiment, the magnetic element M3 mounted inside the toner collecting roller 14 is disposed face to face with the magnetic element M1 mounted inside the magnetic roller 1 in mutually opposite polarities as in the second embodiment depicted in FIG. 4. As shown in FIG. 5A, both end portions H1 of the magnetic element M1 of the magnetic roller 1 are partly cut to prevent an increase in magnetic force produced at the end portions H1 so that the magnetic force is distributed generally in a flat pattern along a longitudinal direction of the magnetic element M1 (or along an axial direction of the magnetic roller 1) and the bladelike projection of the magnetic brush 6 formed between the magnetic roller 1 and the toner collecting roller 14 has a uniform thickness along the longitudinal direction.

Figure 5B:
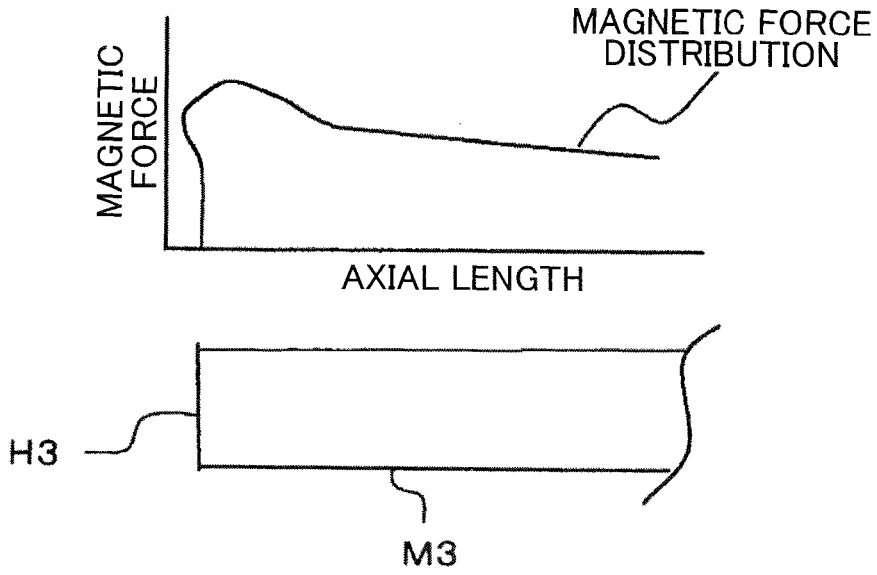
Figure 6:
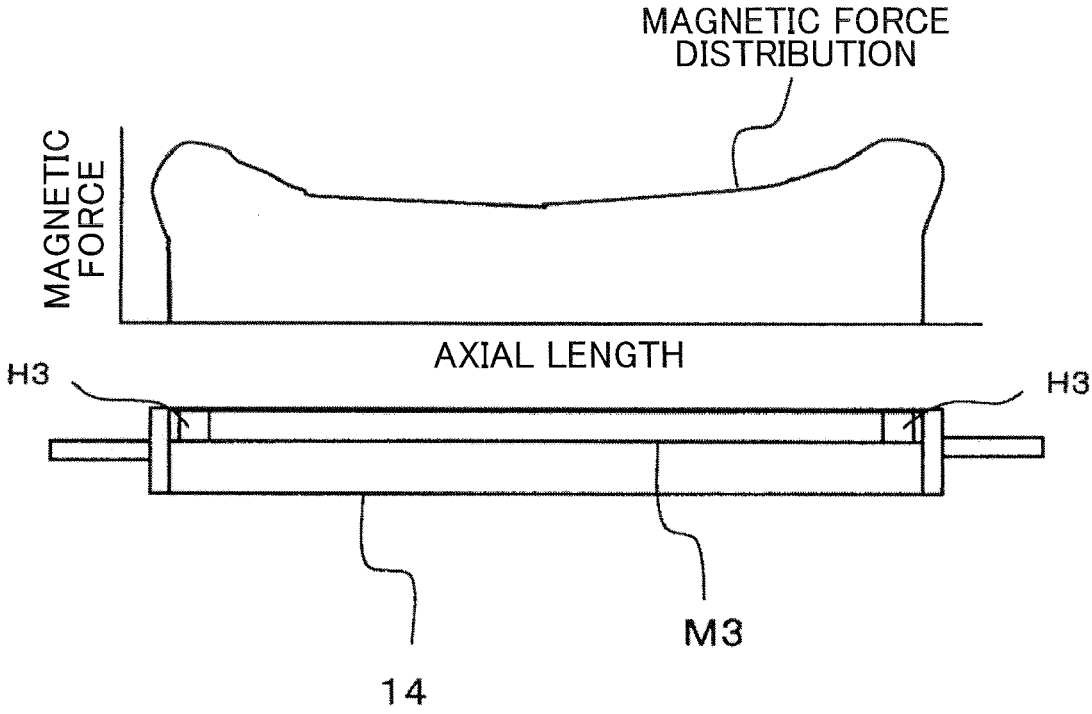
FIG. 6 is a graphical representation of how the magnetic force is distributed along the toner collecting roller of the developing unit of the fourth embodiment.

On the other hand, the magnetic forces produced by the magnetic element M3 at both end portions H3 thereof are made larger than the magnetic force produced by the magnetic element M3 at a middle portion thereof along a longitudinal direction of the magnetic element M3 (or along an axial direction of the toner collecting roller 14) as shown in FIGS. 5B and 6. Specifically, the magnetic forces produced at both end portions H3 of the magnetic element M3 should be 1.01 to 2.0 times, preferably 1.2 to 1.7 times, the magnetic force produced at the middle portion of the magnetic element M3.

Figure 7A:
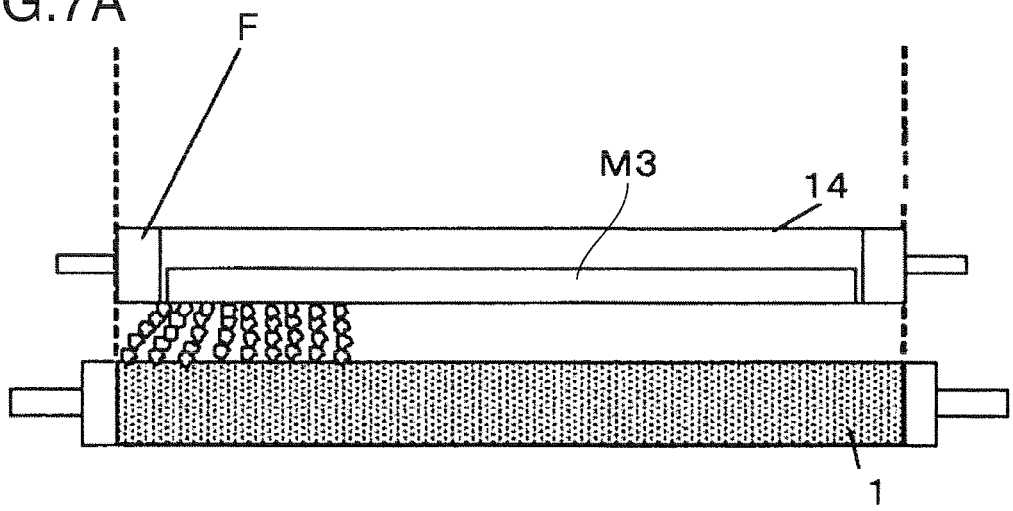
FIGS. 7A, 7B and 7C are schematic diagrams showing how a magnetic brush is formed in the developing unit of the fourth embodiment.
Figure 7B:
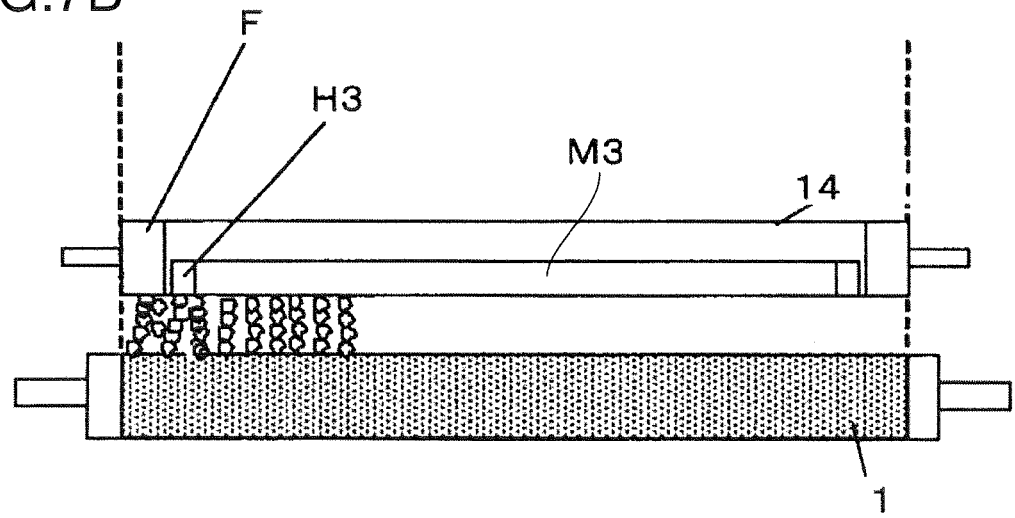
Figure 7C:
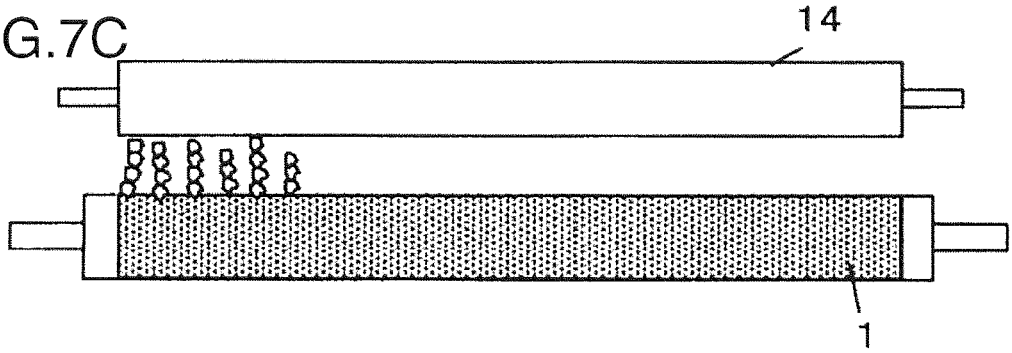

If the magnetic forces produced at both end portions H3 of the magnetic element M3 are not made larger than the magnetic force produced at the middle portion thereof, the bladelike projection of the magnetic brush 6 bridging the gap between the magnetic roller 1 and the toner collecting roller 14 will not be formed up to flanges F of the toner collecting roller 14 at both axial ends thereof as shown in FIG. 7A, so that the scattered toner particles 5 entrapped in the vicinity of the flanges F will not be brought back to the magnetic roller 1. Also, if the magnetic element M3 is not provided in the toner collecting roller 14, the magnetic brush 6 produced on the magnetic roller 1 will only have sparsely distributed projections as shown in FIG. 7C, so that the magnetic brush 6 can not sufficiently scrape off the toner particles 5 collected by the toner collecting roller 14.

In contrast, when the magnetic forces produced at both end portions H3 of the magnetic element M3 are made larger than the magnetic force produced at the middle portion thereof as shown in FIG. 5B, the magnetic forces are concentrated around axial ends of the toner collecting roller 14 and these magnetic forces exert some influence even on areas outward beyond the axial ends of the toner collecting roller 14. As a consequence, the magnetic brush 6 is formed up to the flanges F of the toner collecting roller 14 as shown in FIG. 7B, thereby offering an increased capability to scrape off the toner particles 5 entrapped by and adhering to the toner collecting roller 14 in the areas outward beyond the axial ends thereof.

Since the toner collecting roller 14 collects the toner particles 5 scattered chiefly from around axial ends of the magnetic roller 1, there is the need for a capability to scrape off the toner particles 5 from around the axial ends of the toner collecting roller 14 located outside the opposite end portions H3 of the magnetic element M3. If the magnetic forces produced at both end portions H3 of the magnetic element M3 are smaller than 1.01 times the magnetic force produced at the middle portion thereof, the magnetic brush 6 exerts an extremely little effect of scraping off the toner particles 5 from the toner collecting roller 14 in the areas outward beyond the axial ends thereof. On the other hand, it is not desirable for the magnetic forces produced at both end portions H3 of the magnetic element M3 to exceed 2.0 times the magnetic force produced at the middle portion thereof, because the bladelike projection of the magnetic brush 6 bridging the gap between the magnetic roller 1 and the toner collecting roller 14 becomes so sturdy that too large a torque will be needed for rotating the toner collecting roller 14 in this case.

A range in which the magnetic force produced by the magnetic element M3 is to be relatively increased than at the middle portion (or the length of each end portion H3 of the magnetic element M3 as measured along the longitudinal direction thereof) is 1 to 15 mm, preferably 5 to 10 mm, from each longitudinal end of the magnetic element M3. If this range is shorter than 1 mm, regions of the increased magnetic force of the magnetic element M3 are too narrow so that it is difficult to scrape off the toner particles 5 adhering to the toner collecting roller 14 in areas outward beyond the opposite end portions H3 of the magnetic element M3, or portions of the toner collecting roller 14 where the flanges F are press-fitted thereto. On the other hand, it is not desirable for the aforementioned range of the increased magnetic force of the magnetic element M3 to exceed 15 mm, because the toner particles 5 will be subjected to a great stress and the magnetic forces will exert less influence on the areas outward beyond the opposite end portions H3 of the magnetic element M3. Preferably, both end portions H3 of the magnetic element M3 should have the same length as measured along the longitudinal direction and produce the same magnetic force.

A more specific example of the fourth embodiment is described below.

Example 4

The inventors prepared an image forming apparatus like the one shown in FIG. 2 based on below-described specifications. Specifically, the photosensitive drum 3, the development roller 2, the magnetic roller 1 and the toner collecting roller 14 employed sleeves made of aluminum, measuring 30 mm, 20 mm, 25 mm and 10 mm in diameter, respectively, and were driven to rotate at the following surface turning speeds:

Photosensitive drum 3: 300 mm/sec
Development roller 2: 450 mm/sec
Magnetic roller 1: 675 mm/sec
Toner collecting roller 14: 30 mm/sec The magnetic element M3 was mounted with an offset angle $\alpha$ equal to 5°, and the retrieval pole M1 of the magnetic roller 1 was mounted with an offset angle $\beta$ equal to 5° ($\alpha=\beta=5°$). The magnetic elements M2, M11, M1, M3 produced radially oriented magnetic forces shown below on the surfaces of the respective rollers 2, 1, 14:

Magnetic element M2 (S pole) of development roller 2: 40 mT
Main pole M11 (N pole) of magnetic roller 1: 90 mT
Retrieval pole M1 (S pole) of magnetic roller 1: 80 mT
Magnetic element M3 (N pole) of toner collecting roller 14: 40 mT at middle portion and 55 mT at 10-mm end portions H3

The Tesla Meter Model GX-100 (manufactured by Nihon Denji Sokki Co., Ltd.) was used for measuring the magnetic forces on the surfaces of the magnetic roller 1 and the toner collecting roller 14.

The image forming apparatus thus configured was experimentally run to perform the image forming operation under the following conditions:

Photoreceptor surface potential: +310 V
Q/m of toner in developer: 20 μC/g
Toner particle diameter (mean volume particle diameter): 6.7 μm
Carrier bead diameter (mean weight particle diameter): 45 μm
Distance between magnetic roller and development roller: 350 μm
Distance between magnetic roller and toner collecting roller: 250 μm
Voltage applied to development roller: Vdc2=100 V, Vp-p=1.6 kV, frequency f=2.7 kHz, duty ratio=30%
Voltage applied to magnetic roller: Vdc1=300 V, Vp-p=300 V (same period but in opposite phase with voltage applied to development roller), frequency f=2.7 kHz, duty ratio=70%
Voltage applied to toner collecting roller: Vdc3=200 V (DC Voltage Only)

Experimental results obtained under these conditions have revealed that the image forming apparatus of Example 4 could perform the image forming operation in a stable and desirable fashion while suppressing toner scattering, efficiently returning the scattered toner particles 5 depositing on the axial end portions of the toner collecting roller 14 back to the magnetic roller 1, and suppressing deterioration of the scattered toner particles 5.

Fifth Embodiment

The fifth embodiment discussed below has been devised, focusing in particular on the arithmetic mean surface roughness Ra of the toner collecting roller 14. While the foregoing discussion of the third embodiment has dealt with the arithmetic mean surface roughness Ra of the toner collecting roller 14, the following discussion of the fifth embodiment focuses upon a relationship between the arithmetic mean surface roughness Ra of the toner collecting roller 14 and the ghost phenomenon which may occur in printed images. This embodiment employs basically the same configuration as the second and third embodiments.

According to the fifth embodiment, the toner collecting roller 14 has higher arithmetic mean surface roughness Ra than the development roller 2. Specifically, the toner collecting roller 14 should have an arithmetic mean surface roughness value of 0.505 to 3.0 μm, preferably 0.75 to 2.0 μm.

If the arithmetic mean surface roughness Ra of the toner collecting roller 14 is lower than that of the development roller 2, the toner collecting roller 14 will have less capability to collect the scattered toner particles 5 than the development roller 2 and, in this case, part of the scattered toner particles 5 may be captured by the development roller 2, resulting in a reduction in toner-collecting capability of the toner collecting roller 14. Also, if the scattered toner particles 5 adhere to the development roller 2, the amount of the toner particles 5 to be scraped off and collected from the development roller 2 by the magnetic brush 6 contacting therewith will increase by as much as the amount of the scattered toner particles 5 adhering to the development roller 2, thus causing minor inadequacies of toner removal from the development roller 2. The toner particles 5 unremoved from the development roller 2 deposit thereon eventually forming a residual toner layer carrying a high-voltage static charge on the development roller 2. This residual toner layer can cause the ghost phenomenon to occur at one time or another, making it difficult to maintain stable image forming quality for an extended period of time. Also, if the arithmetic mean surface roughness Ra of the toner collecting roller 14 is lower than 0.505 μm, the toner collecting roller 14 will not have an adequate capability to collect and retain the scattered toner particles 5. If the arithmetic mean surface roughness Ra of the toner collecting roller 14 is higher than 3.0 μm, the toner particles 5 collected by the toner collecting roller 14 will not be adequately taken up by the magnetic brush 6 but deposit on the toner collecting roller 14. On the other hand, the arithmetic mean surface roughness Ra of the development roller 2 should preferably be 0.5 to 1.0 μm.

More specific examples of the fifth embodiment are described below.

Example 5

The inventors prepared an image forming apparatus like the one shown in FIG. 2 based on below-described specifications. Specifically, the photosensitive drum 3, the development roller 2, the magnetic roller 1 and the toner collecting roller 14 employed sleeves made of aluminum, measuring 30 mm, 20 mm, 25 mm and 10 mm in diameter, respectively, and were driven to rotate at the following surface turning speeds:

Photosensitive drum 3: 300 mm/sec
Development roller 2: 450 mm/sec
Magnetic roller 1: 675 mm/sec
Toner collecting roller 14: 30 mm/sec The magnetic element M2 of the development roller 2 and the main pole M11 (N pole) of the magnetic roller 1 produced radially oriented magnetic forces of 45 mT and 90 mT on the surfaces of the respective rollers 2, 1. The Tesla Meter Model GX-100 (manufactured by Nihon Denji Sokki Co., Ltd.) was used for measuring the magnetic forces on the surfaces of the magnetic roller 1 and the toner collecting roller 14.

The arithmetic mean surface roughness Ra of the toner collecting roller 14 and that of the development roller 2 were 0.505 μm and 0.5 μm, respectively, in this image forming apparatus (Example 5-1). The Surface Roughness Meter Model SURFCOM1500DX (manufactured by Tokyo Seimitsu Co., Ltd.) was used for measuring the arithmetic mean surface roughness Ra of the toner collecting roller 14 and the development roller 2 under conditions shown below:

Calculating method: Japanese Industrial Standard JIS-1994

Type of measurement: Measurement of surface roughness

Measurement length: 4.0 mm

Cutoff wavelength: 0.8 mm

Measuring speed: 0.3 mm/sec

Length for evaluation: 4.0 mm

The image forming apparatus thus configured was experimentally run to perform the image forming operation under the following conditions:

Photoreceptor surface potential: +310 V

Q/m of toner in developer: 18 μC/g

Toner particle diameter (mean volume particle diameter): 6.7 μm

Carrier bead diameter (mean weight particle diameter): 55 μm

Distance between magnetic roller and development roller: 350 μm

Distance between magnetic roller and toner collecting roller: 250 μm

Voltage applied to development roller: Vdc2=100 V, Vp-p=1.6 kV, frequency f=2.7 kHz, duty ratio=30%

Voltage applied to magnetic roller: Vdc1=300 V, Vp-p=300 V (same period but in opposite phase with voltage applied to development roller), frequency f=2.7 kHz, duty ratio=70%

Voltage applied to toner collecting roller: Vdc3=200 V (DC voltage only)

Examples 5-2 to 5-5, Comparative Examples 5-1 to 5-3

The inventors further prepared image forming apparatuses as Examples 5-2 to 5-5 of the invention and Comparative Examples 5-1 to 5-3 configured to the same specifications as Example 5-1 discussed above, except that the arithmetic mean surface roughness Ra of the toner collecting roller 14 and that of the development roller 2 were varied to produce different surface roughness combinations and the magnetic forces produced between the toner collecting roller 14 and the magnetic roller 1 and between the development roller 2 and the magnetic roller 1 were combined in different ways as shown in Table 3.

Capabilities of the image forming apparatuses of the aforementioned Examples to collect and return the scattered toner particles 5 to the two-component developer storage space 45 by the toner collecting roller 14 and prevent toner scattering and the ghost phenomenon were evaluated using the below-described evaluation method and criteria.

To evaluate the capabilities to collect and return the scattered toner particles 5 entrapped by and adhering to the toner collecting roller 14 back to the two-component developer storage space 45 with the aid of the magnetic brush 6, the inventors conducted a series of experiments. An evaluation was made by measuring the amounts M (mg/cm$^2$) of the toner particles 5 adhering to the toner collecting roller 14 when the image forming apparatuses just output a 50 copy of an original having a 6% optical density at approximately a 7% toner concentration in the two-component developer. The amounts M (mg/cm$^2$) of the collected toner particles 5 adhering to the toner collecting roller 14 and the amounts of the toner particles 5 adhering to the member 47 were measured by using the Q/M Meter Model 210PS (manufactured by TREK, INC.). Results of evaluation are shown in Table 3 using the following symbols:

◎: M≦0.01

○: 0.01<M≦0.05

Δ: 0.05<M≦0.1 x: 0.1<M

To evaluate the capabilities of the image forming apparatuses of the aforementioned Examples to prevent toner scattering, the developing unit 18 was modified such that the member 47 shown in FIG. 2, which was made of the same ABS resin as the housing 46, could be detached from the developing unit 18. An evaluation was made by comparing the amounts of the toner particles 5 adhering to the inside surface of the member 47 per unit area when the image forming apparatuses just output a 1000th copy of an original having a 6% coverage rate. Results of evaluation are shown in Table 3 using the following symbols:

◎: Less than 0.05 mg/cm$^2$

○: 0.05 mg/cm$^2$ or above but less than 0.1 mg/cm$^2$

Figure 8A:
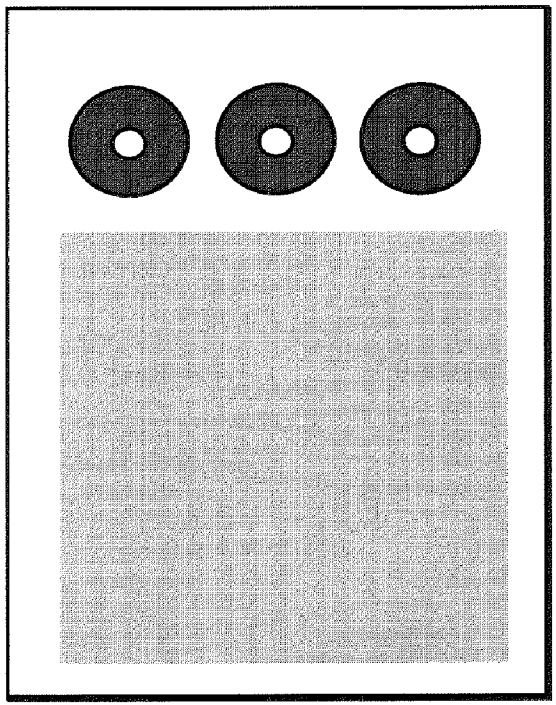
FIGS. 8A and 8B are diagrams showing results of evaluation of a development ghost preventing capability of the developing unit according to the fifth embodiment of the invention.
Figure 8B:
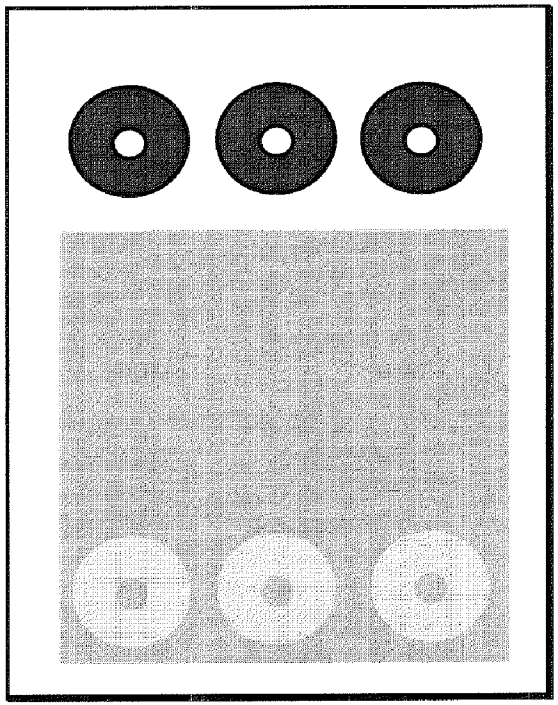

Δ: 0.1 mg/cm$^2$ or above but less than 0.15 mg/cm$^2$ x: 0.15 mg/cm$^2$ or above The capability of the image forming apparatuses to prevent the ghost phenomenon was evaluated by visually inspecting printed images of a pattern shown in FIGS. 8A and 8B obtained when the image forming apparatuses just output a 1000th copy of the same original pattern having a 6% coverage rate. Results of evaluation are shown in Table 3 using the following symbols:

○: No ghost image

Δ: Faint ghost image x: Obvious ghost image

TABLE 3

| | SURFACE ROUGHNESS RA OF TONER COLLECTING ROLLER (μm) | SURFACE ROUGHNESS RA OF DEVELOPMENT ROLLER (μm) | MAGNETIC FORCE BETWEEN FACING MAGNETS IN DEVELOPMENT AND MAGNETIC ROLLERS[1] (mT) | MAGNETIC FORCE BETWEEN FACING MAGNETS IN TONER COLLECTING AND MAGNETIC ROLLER[2] (mT) | RESIDUAL TONER ON TONER COLLECTING ROLLER (mg/cm$^2$) | | SCATTERED TONER (mg/cm$^2$) | | GHOST |
|---|---|---|---|---|---|---|---|---|---|
| EXAMPLE 5-1 | 0.505 | 0.5 | 130 | 135 | 0.012 | ○ | 0.085 | ○ | ○ |
| EXAMPLE 5-2 | 0.75 | 0.5 | 130 | 135 | 0.015 | ○ | 0.084 | ○ | ○ |
| EXAMPLE 5-3 | 1.5 | 0.5 | 130 | 135 | 0.023 | ○ | 0.049 | ◎ | ○ |
| EXAMPLE 5-4 | 3.0 | 1.0 | 130 | 135 | 0.047 | ○ | 0.075 | ○ | ○ |
| EXAMPLE 5-5 | 1.0 | 0.6 | 130 | 135 | 0.018 | ○ | 0.057 | ○ | ○ |
| COMPARATIVE EXAMPLE 5-1 | 0.5 | 0.5 | 130 | 135 | 0.010 | ◎ | 0.115 | Δ | Δ |

TABLE 3-continued

| | SURFACE ROUGHNESS RA OF TONER COLLECTING ROLLER (μm) | SURFACE ROUGHNESS RA OF DEVELOPMENT ROLLER (μm) | MAGNETIC FORCE BETWEEN FACING MAGNETS IN DEVELOPMENT AND MAGNETIC ROLLERS[1)] (mT) | MAGNETIC FORCE BETWEEN FACING MAGNETS IN TONER COLLECTING AND MAGNETIC ROLLER[2)] (mT) | RESIDUAL TONER ON TONER COLLECTING ROLLER ($mg/cm^2$) | | SCATTERED TONER ($mg/cm^2$) | | GHOST |
|---|---|---|---|---|---|---|---|---|---|
| COMPARATIVE EXAMPLE 5-2 | 3.3 | 1.0 | 130 | 135 | 0.059 | Δ | 0.078 | ○ | Δ |
| COMPARATIVE EXAMPLE 5-3 | 0.5 | 0.5 | 130 | 130 | 0.015 | ○ | 0.121 | Δ | X |

[1)]DEVELOPMENT ROLLER MAGNET (S POLE) 45 mT
MAGNETIC ROLLER MAIN POLE (N POLE) 90 mT
[2)]MAGNETIC ROLLER RETRIEVAL POLE (S POLE) 80 mT
TONER COLLECTING ROLLER MAGNET (N POLE) 45 mT

As shown in Table 3, the amount of residual toner particles on the toner collecting roller 14 was small enough in the image forming apparatuses of the aforementioned Examples 5-1 to 5-5 and these image forming apparatuses exhibited appreciable capabilities to collect and return the scattered toner particles 5 entrapped by and adhering to the toner collecting roller 14 back to the two-component developer storage space 45 with the aid of the magnetic brush 6. Additionally, the amount of the scattered toner particles 5 was small in these image forming apparatuses, which exhibited capabilities to successfully collect the scattered toner particles 5 by the toner collecting roller 14 and prevent toner scattering. Furthermore, the image forming apparatuses output high-quality printed images while preventing the ghost phenomenon.

In contrast, none of the image forming apparatuses of the aforementioned Comparative Examples 5-1 to 5-3 exhibited satisfactory capabilities to collect and return the scattered toner particles 5 entrapped by and adhering to the toner collecting roller 14 back to the two-component developer storage space 45, while the capabilities of these image forming apparatuses to reduce the amount of the scattered toner particles 5 and/or prevent the ghost phenomenon were unsatisfactory.

Sixth Embodiment

The sixth embodiment of the invention discussed below has been devised, focusing in particular on a bias voltage applied to the toner collecting roller 14. This embodiment employs otherwise the same configuration as the second embodiment.

Figure 9:
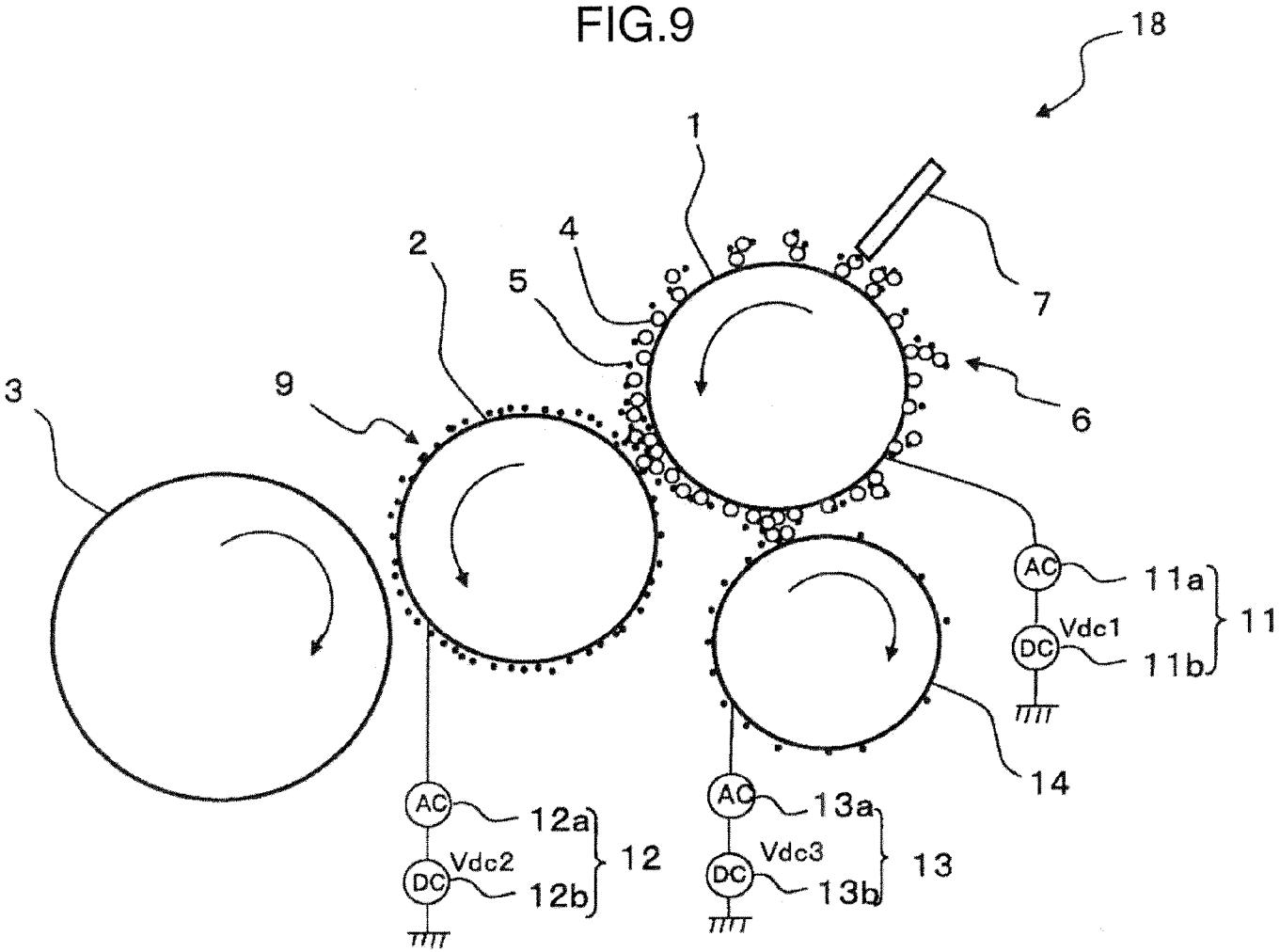
FIG. 9 is a schematic constructional diagram of the developing unit according to the sixth embodiment of the invention.

FIG. 9 is a schematic diagram of a developing unit 18 of an image forming apparatus according to the sixth embodiment. This developing unit 18 differs from the developing units 18 of the foregoing embodiments (FIG. 3) in that there is provided a collection bias applicator 13 including an AC bias voltage source 13*a* and a DC bias voltage source 13*b* for supplying respectively an AC bias voltage and a DC bias voltage Vdc3 which are superimposed on each other to produce an AC/DC-combined bias voltage to be applied to the toner collecting roller 14.

The collection bias applicator 13 applies this combined bias voltage to the toner collecting roller 14 with specified timing to charge the outer surface thereof to the same polarity as the polarity of static charge carried by the toner particles 5 of a type specified to be used in the sixth embodiment to produce a potential difference between the magnetic roller 1 and the toner collecting roller 14 for returning the scattered toner particles 5 collected by the toner collecting roller 14 to the magnetic roller 1. If the toner particles 5 to be used are of a positively charged type, for example, the collection bias applicator 13 applies such a bias voltage to the toner collecting roller 14 that imparts a higher potential thereto than the potential of the magnetic roller 1. As a result, the positively charged toner particles 5 collected by the toner collecting roller 14 are attracted by the magnetic roller 1 charged to the lower potential, so that the toner particles 5 collected by the toner collecting roller 14 can be returned to the magnetic roller 1. Needless to say, if the toner particles 5 to be used are of a negatively charged type, the collection bias applicator 13 should apply such a bias voltage to the toner collecting roller 14 that imparts a lower potential thereto than the potential of the magnetic roller 1.

The collection bias applicator 13 applies the bias voltage to the toner collecting roller 14 with appropriate timing at which the image forming apparatus is not performing any image forming task, such as when a new printing sheet is being fed to the developing unit 18. Alternatively, the collection bias applicator 13 may continuously apply the bias voltage while the image forming apparatus is performing the image forming operation. Preferably, the bias voltage applied by the collection bias applicator 13 is increased at specific intervals, that is, each time the developing unit 18 has been operated for 5 to 10 minutes or when the image forming apparatus produces every 100th to 1000th printout (this timing may be varied depending on accumulated operating time of the developing unit 18), for example, to return the collected toner particles 5 on the toner collecting roller 14 to the magnetic roller 1. It is possible to return the toner particles 5 scattered and deposited especially on the axial end portions of the toner collecting roller 14 to the magnetic roller 1 by increasing the bias voltage applied to the toner collecting roller 14 in the aforementioned manner.

In the image forming apparatus of the sixth embodiment, the magnetic element M3 mounted inside the toner collecting roller 14 is disposed face to face with the magnetic element M1 mounted inside the magnetic roller 1 in mutually opposite polarities as in the second embodiment depicted in FIG. 4.

Figure 10:
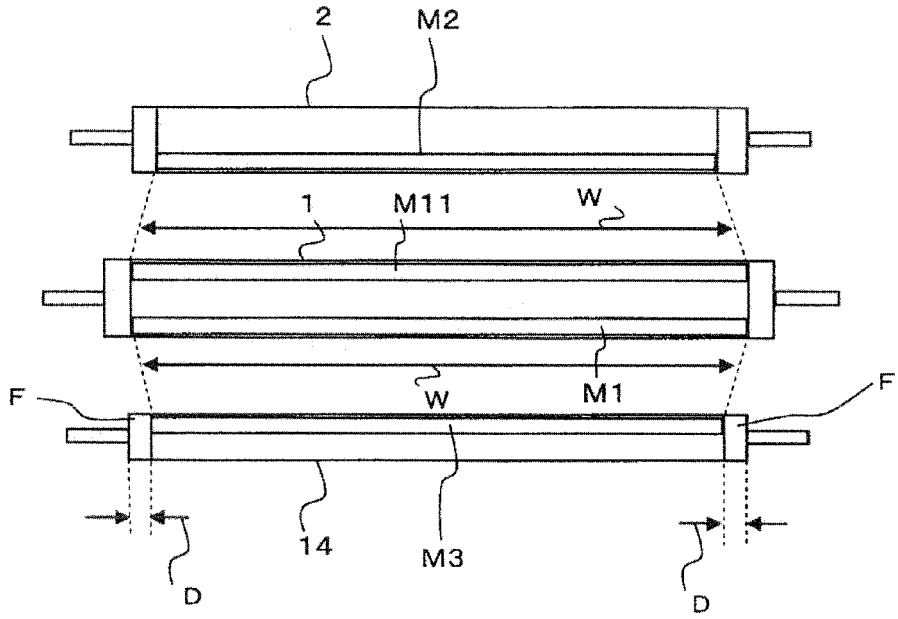
FIG. 10 is a diagram showing a relationship among locations of axial end portions of a toner collecting roller and a development roller and the length of a magnetic brush formed on a magnetic roller in the developing unit of the sixth embodiment.

It is necessary to make the length of the toner collecting roller 14 equal to or shorter than the length of the magnetic brush 6 along the axial direction of the toner collecting roller 14 as shown in FIG. 10 so that the magnetic brush 6 formed on the magnetic roller 1 can retrieve the toner particles 5 collected by the toner collecting roller 14. Axial end portions D of the toner collecting roller 14 where the magnetic element M3 is not mounted must each have a length (along the axial direction) necessary for fitting the flanges F. The magnetic element M3 mounted in the toner collecting roller 14 therefore has a shorter longitudinal length than the magnetic element M1.

As the magnetic element M3 is mounted inside the toner collecting roller 14, there is formed the aforementioned bladelike projection of the magnetic brush 6 bridging the gap between the magnetic roller 1 and the toner collecting roller 14. This bladelike projection of the magnetic brush 6 serves to increase the capability of the magnetic brush 6 to retrieve the toner particles 5 collected by the toner collecting roller 14 back to the magnetic roller 1 in an area covered by the magnetic element M3. This makes it possible to decrease, or even eliminate, the aforementioned bias voltage applied to the toner collecting roller 14.

It is, however, unlikely that the bladelike projection of the magnetic brush 6 would contact the toner particles 5 adhering to the axial end portions D of the toner collecting roller 14 outside a range (longitudinal extension) W in which the bladelike projection of the magnetic brush 6 bridges the gap between the magnetic roller 1 and the toner collecting roller 14, as can be seen from FIG. 10. Therefore, the magnetic brush 6 has a low toner-scraping effect at the axial end portions D of the toner collecting roller 14 and, thus, can not sufficiently scrape off the toner particles 5 adhering to the toner collecting roller 14. Accordingly, if the bias voltage is not applied to the toner collecting roller 14 or decreased, the magnetic brush 6 will not be able to retrieve the toner particles 5 adhering to the axial end portions D of the toner collecting roller 14 back to the magnetic roller 1, causing the toner particles 5 to deposit on the axial end portions D. It is possible to retrieve the toner particles 5 collected by and deposited on the toner collecting roller 14 back to the magnetic roller 1 more efficiently by applying the aforementioned bias voltage to the toner collecting roller 14 with the specified timing mentioned above.

Figure 11:
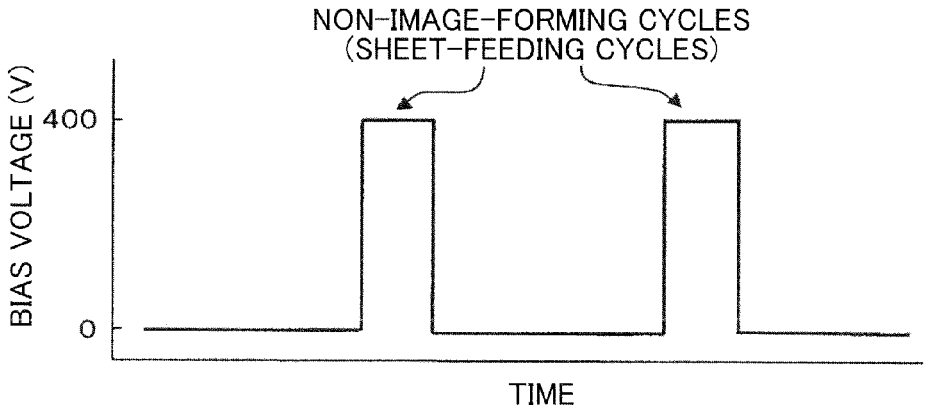
FIG. 11 is a diagram showing an example of a bias voltage applied to the toner collecting roller.

According to the present embodiment, the DC bias voltage Vdc3 applied to the toner collecting roller 14 is made higher than the potentials of the magnetic roller 1 and the development roller 2. Preferably, the DC bias voltage Vdc3 should preferably be 0 to 300 V during execution of each image forming task, 350 to 450 V during a period when no image forming task is in progress. An AC bias voltage may be superimposed on the DC bias voltage Vdc3 applied to the toner collecting roller 14. In this case, the superimposed AC bias voltage should have the same frequency and period as but in opposite phase with the AC bias voltage applied to the magnetic roller 1 and the DC bias voltage Vdc3 should preferably be higher than the potential of the magnetic roller 1. If the bias voltage applied to the toner collecting roller 14 falls within the aforementioned range, it is possible to efficiently return the toner particles 5 scattered and deposited on the axial end portions D of the toner collecting roller 14 back to the magnetic roller 1. Shown in FIG. 11 is an example of the bias voltage applied to the toner collecting roller 14.

More specific examples of the sixth embodiment are described below.

Example 6

The inventors prepared an image forming apparatus like the one shown in FIG. 2 based on below-described specifications. Specifically, the development roller 2, the magnetic roller 1 and the toner collecting roller 14 employed aluminum sleeves with built-in magnets having dimensions shown below:

Development roller 2: Sleeve length 341 mm (including two 5.0-mm flanges), built-in magnet length 330 mm, sleeve diameter 20 mm Magnetic roller 1: Sleeve length 358 mm (including two 6.0-mm flanges), built-in magnet length 343 mm, sleeve diameter 25 mm Toner collecting roller 14: Sleeve length 341 mm (including two 5.0-mm flanges), built-in magnet length 330 mm, sleeve diameter 10 mm Also, the photosensitive drum 3, the development roller 2, the magnetic roller 1 and the toner collecting roller 14 were driven to rotate at the following surface turning speeds:

Photosensitive drum 3: 300 mm/sec

Development roller 2: 450 mm/sec

Magnetic roller 1: 675 mm/sec

Toner collecting roller 14: 30 mm/sec

The magnetic element M3 of the toner collecting roller 14 was mounted with an offset angle $\alpha$ equal to 5°, and the retrieval pole M1 of the magnetic roller 1 was mounted with an offset angle $\beta$ equal to 5' ($\alpha=\beta=5'$). The magnetic elements M11, M1, M2, M3 having longitudinal lengths shown below produced radially oriented magnetic forces shown below on the surfaces of the respective rollers 1, 2, 14:

Main pole M11 (N pole) of magnetic roller 1: 90 mT, length 343 mm

Retrieval pole M1 (S pole) of magnetic roller 1: 80 mT, length 343 mm

Magnetic element M2 (S pole) of development roller 2: 40 mT, length 330 mm Magnetic element M3 (N pole) of toner collecting roller 14: 40 mT, length 330 mm The Tesla Meter Model GX-100 (manufactured by Nihon Denji Sokki Co., Ltd.) was used for measuring the magnetic forces on the surfaces of the magnetic roller 1 and the toner collecting roller 14.

The image forming apparatus thus configured was experimentally run to perform the image forming operation under the following conditions:

Photoreceptor surface potential: +310 V

Q/m of toner in developer: 18 μC/g

Toner particle diameter (mean volume particle diameter): 6.5 μm

Carrier bead diameter (mean weight particle diameter): 45 μm

Distance between magnetic roller and development roller: 350 μm

Distance between magnetic roller and toner collecting roller: 250 μm

Voltage applied to development roller: Vdc2=100 V, Vp-p=1.6 kV, frequency f=2.7 kHz, duty ratio=27%

Voltage applied to magnetic roller: Vdc1=300 V, Vp-p=300 V (same period but in opposite phase with voltage applied to development roller), frequency f=2.7 kHz, duty ratio=73%

Voltage applied to toner collecting roller: Vdc3=0 V during image-forming cycles, Vdc3=400 V (DC voltage only) during non-image-forming cycles After the image forming apparatus of the aforementioned Example 6 (hereinafter referred to as Example 6-1) had output 100 printouts, the image forming apparatus was set to run at 1.1-second non-image-forming cycles. Alternatively, the surface turning speed of the toner collecting roller 14 during the non-image-forming cycles may be made variable up to 100 mm/sec with the non-image-forming cycles shortened to 314 milliseconds at this point.

As Example 6-2 of the present embodiment, the image forming apparatus was run to perform the image forming operation under the same conditions as in Example 6-1 except that the following bias voltages were applied to the toner collecting roller 14: Vdc3=0 V during image-forming cycles, and Vdc3=300 V at Vp-p=1.6 kV, frequency f=2.7 kHz and duty ratio=27% having the same period but in opposite phase with the voltage applied to the magnetic roller 1 during non-image-forming cycles.

Also, as Comparative Example 6-1, the image forming apparatus was run to perform the image forming operation under the same conditions as in Example 6-1 except that the DC bias voltage Vdc3=0 V was applied to the toner collecting roller 14 during both the image-forming and non-image-forming cycles.

After the image forming apparatus thus configured had successively output 100 printouts, the duration of the non-image-forming cycle was set to 1.1 seconds and the image forming apparatus was kept running until a 5000th printout is delivered. Then, after the image forming apparatus had produced the 5000th printout, the toner particles 5 adhering to the axial end portions D of the toner collecting roller 14 were sucked and, for the purpose of evaluation, the weight of the sucked toner particles 5 was measured by using the Q/M Meter Model 210PS (manufactured by TREK, INC.). Measurement results are as shown below:

Example 6-1: 0.011 mg

Example 6-2: 0.006 mg

Comparative Example 6-1: 0.144 mg

It is appreciated from these measurement results that the amount of the toner particles 5 adhering to the axial end portions D of the toner collecting roller 14 was extremely small in Examples 6-1 and 6-2. Additionally, it was possible to return the toner particles 5 scattered and deposited on the axial end portions D (flanges F) of the toner collecting roller 14, where the magnetic element M3 was not mounted, back to the magnetic roller 1 and thus prevent toner scattering.

In Comparative Example 6-1, however, the toner particles 5 adhered to the axial end portions D of the toner collecting roller 14 in large quantities and it was not possible to return the toner particles 5 deposited on the axial end portions D back to the magnetic roller 1 with the aid of the magnetic brush 6, resulting in an increase in toner scattering, for instance.

Seventh Embodiment

Figure 12:
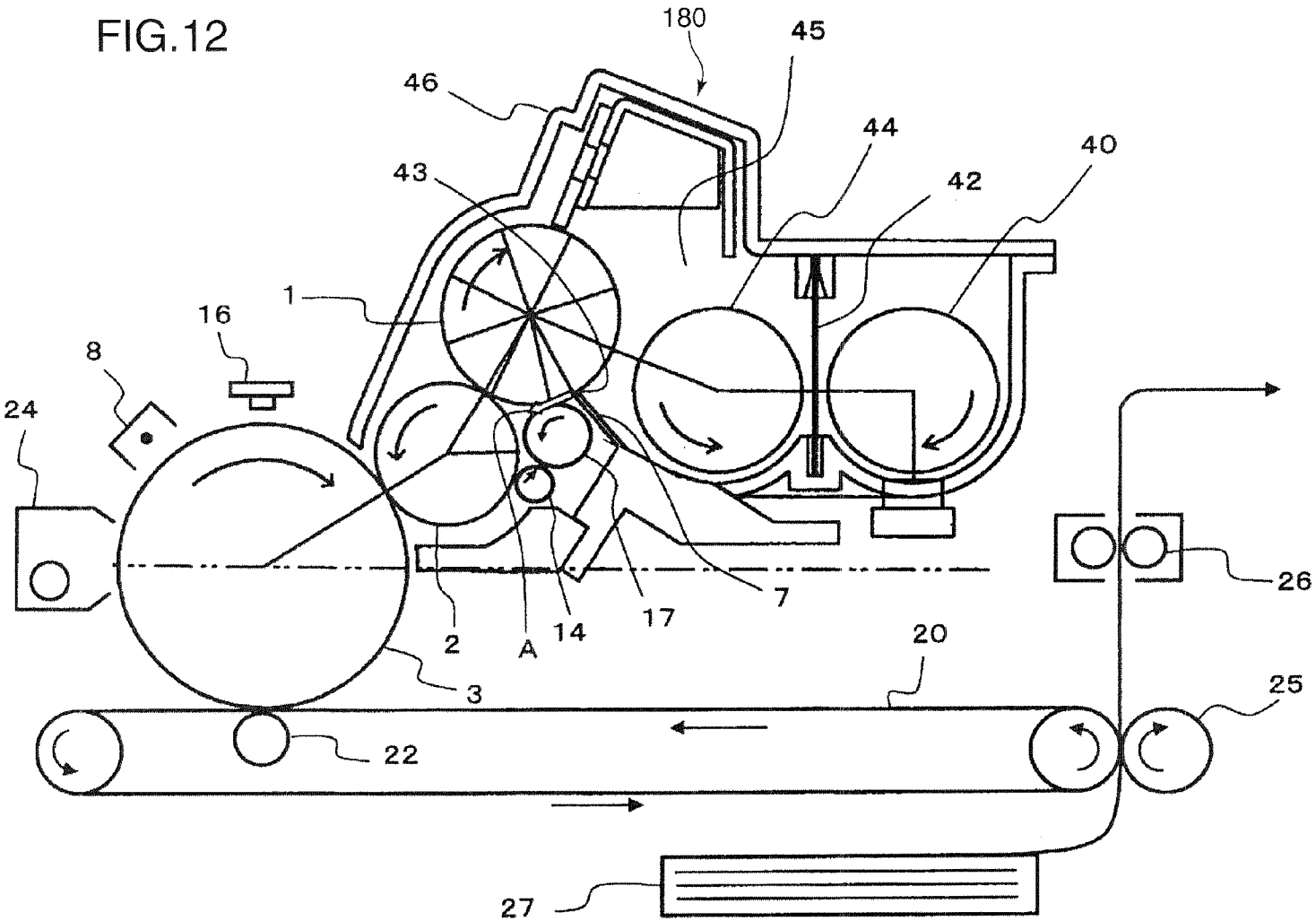
FIG. 12 is an explanatory diagram generally showing the configuration of an image forming apparatus using touchdown development according to the seventh embodiment.
Figure 13:
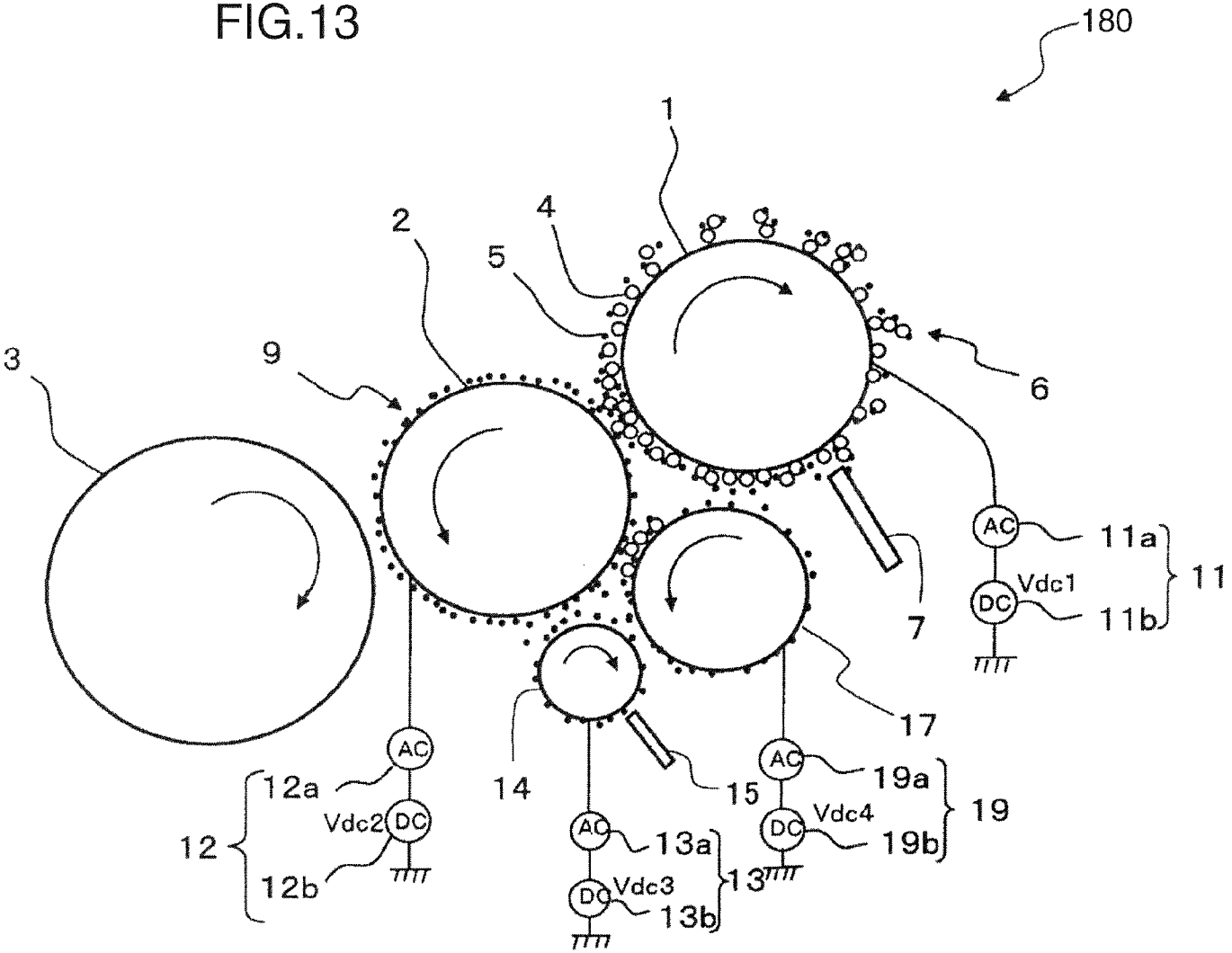
FIG. 13 is a schematic constructional diagram of the developing unit of the seventh embodiment of the invention.

An image forming apparatus according to the seventh embodiment of the invention is characterized by including a developing unit 180 provided with a toner collecting magnetic roller 17 (toner-collecting developer carrying member) in addition to the rollers 1, 2, 14 of the developing units 18 of the first to sixth embodiments. FIG. 12 is an explanatory diagram generally showing the configuration of the image forming apparatus according to the seventh embodiment, and FIG. 13 is a schematic constructional diagram of the developing unit 180 of the seventh embodiment. The developing unit 180 of this embodiment has basically the same configuration as the developing units 18 of the first to sixth embodiments except for the provision of the toner collecting magnetic roller 17.

Specifically, the developing unit 180 is provided with the toner collecting magnetic roller 17 in addition to the magnetic roller (toner feeding magnetic roller) 1, the development roller 2 and the toner collecting roller 14 discussed in the foregoing embodiments. The toner collecting magnetic roller 17 is a roller capable of carrying the developer and collecting the toner particles 5 which are left unused for development on the development roller 2 and returning the unused toner particles 5 back to the magnetic roller 1.

Figure 14:
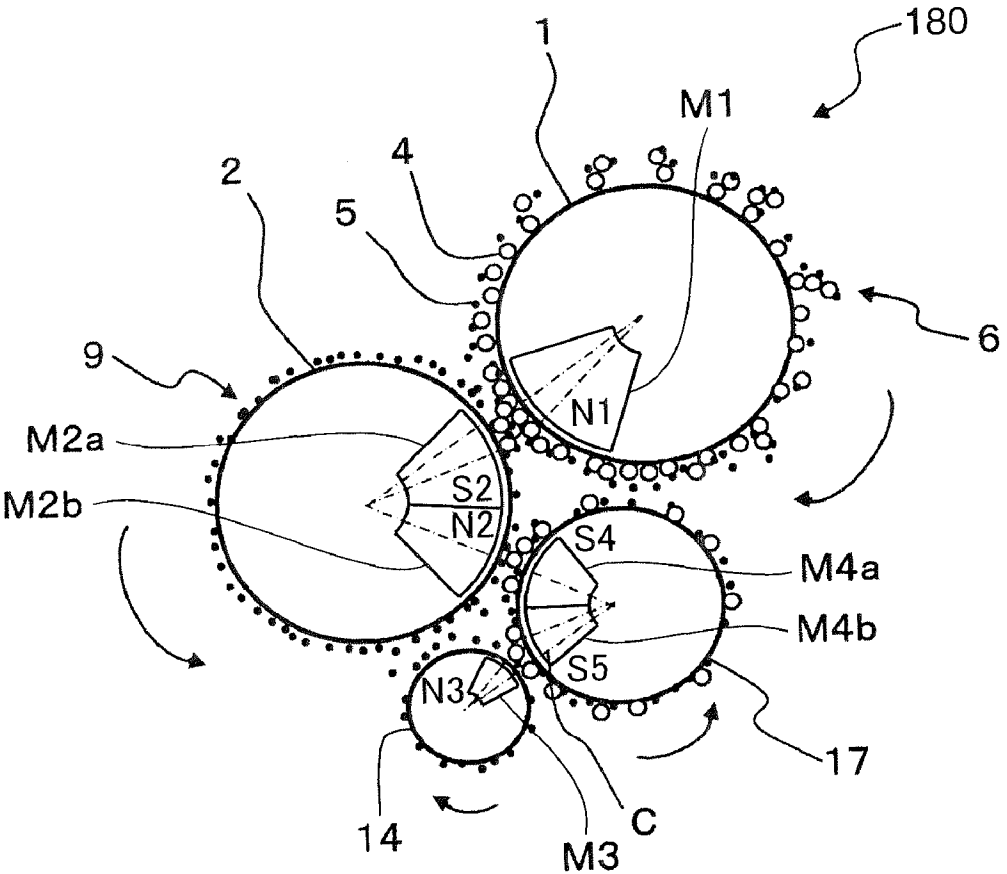
FIG. 14 is also a schematic constructional diagram of the developing unit of the seventh embodiment of the invention.

The toner particles 5 left unused for development on the development roller 2 are collected mainly by the toner collecting magnetic roller 17 which is disposed face to face with both the development roller 2 and the magnetic roller 1. As shown in FIG. 14, there is formed a projection of a magnetic brush 6 between the thin toner layer 9 and the toner collecting magnetic roller 17 by a magnetic field formed between an N pole (N2) of a magnetic element M2*b* mounted in the development roller 2 and an S pole (S4) of a magnetic element M4*a* mounted in the toner collecting magnetic roller 17. This projection of the magnetic brush 6 serves to scrape off and collect the toner particles 5 left unused on the development roller 2 to the toner collecting magnetic roller 17. Another magnetic element M2*a* mounted in the development roller 2 corresponds to the magnetic element M2 (see FIG. 4) discussed in the foregoing embodiments.

In the seventh embodiment, the toner collecting roller 14 also collects the unused toner particles 5 on the development roller 2 while the toner collecting magnetic roller 17 collects the unused toner particles 5 from the development roller 2. Additionally, the toner collecting roller 14 serves to collect the toner particles 5 scattered when the toner collecting magnetic roller 17 collects the unused toner particles 5 from the development roller 2 as well as the toner particles 5 scattered and suspended in the vicinity of the development roller 2. For this reason, the toner collecting roller 14 is disposed face to face with both the development roller 2 and the toner collecting magnetic roller 17.

The above-described configuration of the embodiment makes it possible to collect the toner particles 5 scattered and suspended in the vicinity of the development roller 2 as well as the toner particles 5 which are going to flow through the clearance beneath the toner feeding magnetic roller 1 in the arrow direction A shown in FIG. 2 and scatter inside the image forming apparatus by causing these toner particles 5 to adhere to the outer surface of the toner collecting roller 14 by intermolecular attraction and electrostatic attraction, for instance.

As the toner collecting roller 14 rotates, the scattered toner particles 5 collected by the toner collecting roller 14 and adhering to the outer surface thereof and the toner particles 5 left unused for development on the development roller 2 and collected therefrom to the toner collecting roller 14 are scraped off as a result of contact with the magnetic brush 6 formed on the toner collecting magnetic roller 17 and returned to the magnetic roller 1.

Although the toner collecting roller 14 and the toner collecting magnetic roller 17 may be driven to rotate in such a manner that closest facing parts of the two rollers 14, 17 move in the same direction (co-rotation) or in opposite directions (counter-rotation), the two rollers 14, 17 should preferably be driven to produce co-rotation. If the two rollers 14, 17 are in a co-rotation configuration, the toner particles 5 on the surface of the toner collecting roller 14 can be taken up to the toner collecting magnetic roller 17 quickly and easily with a reduced stress on the collected toner particles 5. This serves to suppress deterioration of the collected toner particles 5.

Surface turning speed of the toner collecting roller 14 should be 10 to 100 mm/sec, preferably 20 to 70 mm/sec. At surface turning speeds of the toner collecting roller 14 below 10 mm/sec, rotating speed of the toner collecting roller 14 is so low that the amount of the scattered toner particles 5 collected by the toner collecting roller 14 would be too small. Also, surface turning speeds of the toner collecting roller 14 exceeding 100 mm/sec are undesirable as the capability of the toner collecting roller 14 to collect the scattered toner particles 5 decreases and the toner particles 5 adhering to the outer surface of the toner collecting roller 14 are likely to scatter again when scraped by the magnetic brush 6 of the toner collecting magnetic roller 17. The surface turning speeds of the toner collecting roller 14 exceeding 100 mm/sec are undesirable also because the toner collecting roller 14 may attract and take up the carrier beads 4 from the magnetic brush 6 formed on the toner collecting magnetic roller 17.

It is desirable to mount inside the toner collecting roller 14 the magnetic element M3 having an opposite polarity with a magnetic element M4*b* mounted inside the toner collecting magnetic roller 17 in such a way that the magnetic element M3 of the toner collecting roller 14 is disposed face to face with the magnetic element M4*b* of the toner collecting magnetic roller 17 as shown in FIG. 14. Preferably, the center of the magnetic element M3 of the toner collecting roller 14 is offset to the upstream side along the rotating direction of the toner collecting roller 14 with respect to a straight line C connecting centers of the toner collecting magnetic roller 17 and the toner collecting roller 14 as seen in cross section. An offset angle to the upstream side of the magnetic element M3 of the toner collecting roller 14 is 1° to 6°, preferably approximately 5°.

On the other hand, the center of the magnetic element M4*b* (retrieval pole M4*b*) of the toner collecting magnetic roller 17 is preferably offset to an upstream side along the rotating direction of the toner collecting magnetic roller 17 with respect to the aforementioned straight line C. An offset angle to the upstream side of the retrieval pole M4*b* of the toner collecting magnetic roller 17 is preferably 1° to 6°, and more preferably approximately 5°. An arrangement in which this offset angle is smaller than 1° is undesirable as the carrier beads 4 might be attracted to the toner collecting roller 14. An arrangement in which this offset angle is larger than 6° is also undesirable because this arrangement produces too small an attractive force for returning the toner particles 5 on the toner collecting roller 14 to the toner collecting magnetic roller 17, possibly causing an inability to perform toner collection.

The magnetic element M3 of the toner collecting roller 14 and the retrieval pole M4*b* of the toner collecting magnetic roller 17 disposed face to face with each other have opposite polarities at their radially outer ends. In the illustrated example of FIG. 14, the magnetic element M3 is an N pole (N3) and the retrieval pole M4*b* is an S pole (S5).

As the magnetic element M3 and the retrieval pole M4*b* respectively mounted inside the toner collecting roller 14 and the toner collecting magnetic roller 17 are disposed in the aforementioned fashion, the magnetic element M3 (N pole) of the toner collecting roller 14 is located face to face with the retrieval pole M4*b* (S pole) of the toner collecting magnetic roller 17. As a consequence, there is formed a magnetic field and, thus, a bladelike projection of the magnetic brush 6 between the toner collecting roller 14 and the toner collecting magnetic roller 17 in an area upstream of the closest facing parts of the two rollers 14, 17.

As illustrated in FIG. 14, this bladelike projection of the magnetic brush 6 formed between the toner collecting roller 14 and the toner collecting magnetic roller 17 is inclined to a downstream side of the aforementioned straight line C with respect to the rotating direction of the toner collecting magnetic roller 17 in this embodiment. Therefore, the toner particles 5 adhering to the toner collecting roller 14 can be carried downstream along the rotating direction of the toner collecting magnetic roller 17 more easily after being scraped off by a mechanical force exerted by the magnetic brush 6, so that the collected toner particles 5 can be efficiently retrieved by the toner collecting magnetic roller 17 without depositing on the toner collecting roller 14.

Furthermore, since the toner collecting roller 14 and the toner collecting magnetic roller 17 are configured such that the closest facing parts of the two rollers 14, 17 move side by side in the same direction, it is possible to reduce stress on the collected toner particles 5 and prevent deterioration thereof.

As shown in FIG. 13, the toner collecting roller 14 is provided with a static eliminating mechanism 15 for eliminating static charge from the collected toner particles 5. The provision of the static eliminating mechanism 15 serves to prevent an increase in the level of accumulated static charges inside the developing unit 180.

There is a gap of 200 to 600 μm, preferably 300 to 400 μm, between the magnetic roller 1 and the development roller 2. A gap between the toner collecting roller 14 and the toner collecting magnetic roller 17 is required to permit the magnetic brush 6 formed on the toner collecting magnetic roller 17 to just touch the outer surface of the toner collecting roller 14 and should therefore be made approximately equal to a gap between the development roller 2 and the toner collecting magnetic roller 17. Specifically, the gap between the toner collecting roller 14 and the toner collecting magnetic roller 17 should be 200 to 600 μm, preferably 300 to 400 μm.

In the above-described configuration of the embodiment, it is possible to retrieve the collected toner particles 5 to the toner collecting magnetic roller 17 with a reduced stress on the toner particles 5 by making the distance between the toner collecting roller 14 and the toner collecting magnetic roller 17 approximately equal to the distance between the magnetic roller 1 and the development roller 2.

A more specific example of the seventh embodiment is described below.

Example 7

The inventors prepared an image forming apparatus like the one shown in FIG. 12 based on below-described specifications. The photosensitive drum 3 was a 30-mm-diameter photosensitive drum with an amorphous silicon photoreceptor, the development roller 2 employed a 20-mm-diameter sleeve made of anodized aluminum, the magnetic roller 1 employed a 25-mm-diameter sleeve made of aluminum, the toner collecting magnetic roller 17 employed a 20-mm-diameter sleeve made of aluminum, and the toner collecting roller 14 employed a 10-mm-diameter sleeve made of aluminum.

The development roller 2 and the toner collecting magnetic roller 17 were in a counter-rotation configuration so that closest facing parts of the two rollers 2, 17 would move in opposite directions, whereas the toner collecting roller 14 and the toner collecting magnetic roller 17 were in a co-rotation configuration so that the closest facing parts of the two rollers 14, 17 move in the same direction.

The photosensitive drum 3, the development roller 2, the magnetic roller 1, the toner collecting magnetic roller 17 and the toner collecting roller 14 were driven to rotate at the following surface turning speeds:

Photosensitive drum 3: 300 mm/sec
Development roller 2: 450 mm/sec
Toner feeding magnetic roller 1: 675 mm/sec
Toner collecting magnetic roller 17: 675 mm/sec
Toner collecting roller 14: 30 mm/sec The image forming apparatus thus configured was experimentally run to perform the image forming operation under the following conditions:

Photoreceptor surface potential: +310 V
Q/m of toner in developer: 20 μC/g
Toner particle diameter (mean volume particle diameter: D50): 7.5 μm
Carrier bead diameter (mean weight particle diameter: D50): 50 μm Distance between toner feeding magnetic roller 1 and development roller 2: 350 μm Distance between development roller 2 and toner collecting roller 14: 350 μm Distance between toner collecting magnetic roller 17 and toner collecting roller 14: 350 μm Voltage applied to development roller 2: Vdc2=200 V, Vp-p=1.6 kV, frequency f=2.7 kHz, duty ratio=27%

Voltage applied to toner feeding magnetic roller 1: Vdc1=400 V, Vp-p=300 V, frequency f=2.7 kHz, duty ratio=27%

Voltage applied to toner collecting magnetic roller 17: Vdc4=400 V, Vp-p=300 V, frequency f=2.7 kHz, duty ratio=27%

Voltage applied to toner collecting roller 14: Vdc3=100 V (DC Voltage Only)

Experimental results obtained under these conditions have revealed that the image forming apparatus of Example 7 could perform the image forming operation in a stable and desirable fashion while efficiently collecting the toner particles 5 left unused for development on the development roller 2 and suppressing toner scattering.

Various arrangements of the present invention have thus far been discussed in detail with reference to the preferred embodiments and specific Examples thereof.

In summary, an image forming apparatus according to one aspect of the invention includes a latent image carrying member on which an electrostatic latent image is formed, a two-component developer carrying member which rotates while magnetically holding on an outer surface a developer containing carrier beads and toner particles, the two-component developer carrying member having a first magnetic element mounted therein, a toner carrying member carrying on an outer surface a thin toner layer formed of the toner particles supplied from the two-component developer carrying member, a toner collecting roller for collecting the toner particles scattered and suspended in the vicinity of the two-component developer carrying member and the toner carrying member, a housing having an inside wall accommodating the two-component developer carrying member, the toner carrying member and the toner collecting roller, and a first voltage applicator for applying a development bias voltage to at least one of the toner carrying member and the two-component developer carrying member for developing the electrostatic latent image. In this image forming apparatus, the toner collecting roller is located between the two-component developer carrying member and the inside wall of the housing at a location downstream of an area where the two-component developer carrying member and the toner carrying member are closest to each other with respect to a rotating direction of the two-component developer carrying member, and the toner particles scattered and adhering to the toner collecting roller are retrieved by a magnetic brush formed on the outer surface of the two-component developer carrying member.

In the image forming apparatus thus configured, it is possible to collect the scattered toner particles by causing the scattered toner particles to adhere to the toner collecting roller. Since the scattered toner particles which have adhered to the toner collecting roller are returned to the two-component developer carrying member by the magnetic brush formed on the outer surface of the two-component developer carrying member, it is not necessary to provide a dedicated path for returning the toner particles to the two-component developer stored in a developing unit. Additionally, this configuration does not use a scraping blade or like means for collecting residual toner particles, making it possible to reduce stress on the toner particles, suppress toner scattering, deterioration of the toner particles and the ghost phenomenon especially in high-speed machines, and eventually attain stable image forming quality for an extended period of time.

In the image forming apparatus thus configured, it is preferable that the toner collecting roller be provided with a second magnetic element mounted therein, the first and second magnetic elements being disposed to face each other with oppositely directed polarities.

According to this configuration, the magnetic brush formed between the toner collecting roller and the two-component developer carrying member serves to prevent the scattered toner particles from flowing out of the housing of the developing unit and to efficiently return the scattered toner particles collected by the toner collecting roller and adhering to an outer surface thereof back to the two-component developer carrying member.

In the image forming apparatus thus configured, it is preferable that a magnetic force acting between the toner collecting roller and the two-component developer carrying member be made larger than a magnetic force acting between the toner carrying member and the two-component developer carrying member.

This configuration enhances a magnetic retaining force between the toner collecting roller and the two-component developer carrying member, whereby a bladelike projection of the aforementioned magnetic brush serves to prevent the scattered toner particles from flowing through an opening between the two-component developer carrying member and the wall of the housing and securely entrap the scattered toner particles.

It is further preferable that the second magnetic element be mounted along an axial direction of the toner collecting roller, and magnetic forces produced by the second magnetic element at opposite axial end portions of the toner collecting roller be made larger than a magnetic force produced by the second magnetic element at a middle portion of the toner collecting roller.

This configuration enhances a capability of the magnetic brush to scrape off the toner particles from the axial end portions of the toner collecting roller, making it possible to effectively return the toner particles deposited on the axial end portions of the toner collecting roller with the magnetic brush.

In the image forming apparatus thus configured, it is preferable that the toner collecting roller have arithmetic mean surface roughness falling in a range of 0.505 to 3.0 μm which is higher than that of the toner carrying roller.

This configuration can increase adhesion of the scattered toner particles to the outer surface of the toner collecting roller.

Preferably, the image forming apparatus thus configured further includes a second voltage applicator for applying a bias voltage for collecting the scattered toner particles to the toner collecting roller.

As the second voltage applicator applies the bias voltage to the toner collecting roller in this configuration, it is possible to easily return the toner particles collected by and deposited on the toner collecting roller, especially on the axial end portions thereof, to the two-component developer carrying member.

In the image forming apparatus thus configured, it is preferable that the latent image carrying member be driven at a surface turning speed of at least 180 mm/sec. The present invention can be preferably applied to such high-speed machines in which it is generally difficult to collect the scattered toner particles for reuse.

In the image forming apparatus thus configured, it is preferable that the toner collecting roller be driven to rotate at a surface turning speed lower than that of the two-component developer carrying member.

Furthermore, it is preferable that closest facing parts of the toner collecting roller and the two-component developer carrying member move circumferentially in the same direction. This arrangement serves to reduce stress on the toner particles and suppress deterioration of the toner particles.

According to another aspect of the invention, an image forming apparatus includes a latent image carrying member on which an electrostatic latent image is formed, a two-component developer carrying member which rotates while magnetically holding on an outer surface a developer containing carrier beads and toner particles, the two-component developer carrying member having a first magnetic element mounted therein, a toner carrying member carrying on an outer surface a thin toner layer formed of the toner particles supplied from the two-component developer carrying member, a toner collecting roller for collecting the toner particles scattered and suspended in the vicinity of the two-component developer carrying member and the toner carrying member, the toner collecting roller having a second magnetic element mounted therein, a housing accommodating the two-component developer carrying member, the toner carrying member and the toner collecting roller, and a first voltage applicator for applying a development bias voltage to at least one of the toner carrying member and the two-component developer carrying member for developing the electrostatic latent image. In this image forming apparatus, the toner collecting roller is disposed face to face with the two-component developer carrying member, and the first and second magnetic elements are disposed to face each other with oppositely directed polarities.

In the image forming apparatus thus configured, it is possible to cause the scattered toner particles to adhere to an outer surface of the toner collecting roller by intermolecular attraction and electrostatic attraction, for instance. Also, since the second magnetic element having a polarity opposite to that of the first magnetic element of the two-component developer carrying member is mounted in the toner collecting roller, a magnetic brush is formed between the toner collecting roller and the two-component developer carrying member, and this magnetic brush serves to prevent the scattered toner particles from flowing out of the housing of the developing unit and to efficiently return the scattered toner particles collected by the toner collecting roller and adhering to the outer surface thereof back to the two-component developer carrying member. It is therefore possible to suppress toner scattering and deterioration of the toner particles, and eventually attain stable image forming quality for an extended period of time.

According to a still another aspect of the invention, an image forming apparatus includes a latent image carrying member on which an electrostatic latent image is formed, a toner carrying member disposed face to face with the latent image carrying member and carrying on an outer surface toner particles for developing the electrostatic latent image, a toner-feeding developer carrying member disposed face to face with the toner carrying member and carrying a two-component developer containing the toner particles and magnetic carrier beads for supplying the toner particles to the toner carrying member, the toner-feeding developer carrying member having a third magnetic element mounted therein, a toner-collecting developer carrying member disposed face to face with the toner carrying member and carrying the two-component developer for collecting the toner particles from the toner carrying member, the toner-collecting developer carrying member having a fourth magnetic element mounted in therein, and a toner collecting roller for collecting the toner particles scattered and suspended in the vicinity of the toner carrying member. In this image forming apparatus, the toner-collecting developer carrying member and the toner carrying roller are in a counter-rotation configuration so that closest facing parts of these two rollers move in opposite directions, and the toner collecting roller is disposed face to face with both the toner-collecting developer carrying member and the toner carrying member.

Since the toner-collecting developer carrying member for collecting the toner particles from the toner carrying member and the toner carrying member are driven to produce counter-rotation such that the closest facing parts of these two rollers move in opposite directions in this image forming apparatus, it is possible to efficiently collect the toner particles left unused for development on the toner carrying member. The toner collecting roller for collecting the toner particles scattered when the toner-collecting developer carrying member collects the unused toner particles on the toner carrying member is located face to face with both the toner-collecting developer carrying member and the toner carrying member as mentioned above. It is therefore possible to collect the toner particles scattered during a process of collecting the unused toner particles from the toner carrying member. This arrangement makes it possible to refresh a toner layer formed on the toner carrying member in a desired fashion, suppress toner scattering, and eventually attain stable image forming quality for an extended period of time.

This application is based on patent application Nos. 2007-018544, 2007-018545, 2007-018546, 2007-018547, 2007-020951, 2007-020948 and 2007-020950 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An image forming apparatus comprising:

a latent image carrying member on which an electrostatic latent image is formed;

a two-component developer carrying member which rotates while magnetically holding on an outer surface a developer containing carrier beads and toner particles, said two-component developer carrying member having magnetic element mounted therein;

a toner carrying member carrying on an outer surface a thin toner layer formed of the toner particles supplied from said two-component developer carrying member;

a toner collecting roller for collecting the toner particles scattered and suspended in the vicinity of said two-component developer carrying member and said toner carrying member;

a housing having an inside wall accommodating said two-component developer carrying member, said toner carrying member and said toner collecting roller; and voltage applicator for applying a development bias voltage to at least one of said toner carrying member and said two-component developer carrying member for developing the electrostatic latent image;

wherein said toner collecting roller is located between said two-component developer carrying member and the inside wall of said housing at a location downstream of an area where said two-component developer carrying member and said toner carrying member are closest to each other with respect to a rotating direction of said two-component developer carrying member, and the toner particles scattered and adhering to said toner collecting roller are retrieved by a magnetic brush formed on the outer surface of said two-component developer carrying member.

2. The image forming apparatus according to claim 1, wherein the magnetic element mounted in the two-component developer carrying member is a first magnetic element, and wherein said toner collecting roller is provided with a second magnetic element mounted therein, the first and second magnetic elements being disposed to face each other with oppositely directed polarities.

3. The image forming apparatus according to claim 2, wherein a magnetic force acting between said toner collecting roller and said two-component developer carrying member is made larger than a magnetic force acting between said toner carrying member and said two-component developer carrying member.

4. The image forming apparatus according to claim 2, wherein the second magnetic element is mounted along an axial direction of said toner collecting roller, and magnetic forces produced by the second magnetic element at opposite axial end portions of said toner collecting roller are made larger than a magnetic force produced by the second magnetic element at a middle portion of said toner collecting roller.

5. The image forming apparatus according to claim 1, wherein said toner collecting roller has arithmetic mean surface roughness falling in a range of 0.505 to 3.0 μm which is higher than that of said toner carrying roller.

6. The image forming apparatus according to claim 1, wherein the voltage applicator for applying a development bias voltage to at least one of said toner carrying member and said two-component developer carrying member is a first voltage applicator, said apparatus further comprising a second voltage applicator for applying a bias voltage for collecting the scattered toner particles to said toner collecting roller.

7. The image forming apparatus according to claim 1, wherein said latent image carrying member is driven at a surface turning speed of at least 180 mm/sec.

8. The image forming apparatus according to claim 1, wherein said toner collecting roller is driven to rotate at a surface turning speed lower than that of said two-component developer carrying member.

9. An image forming apparatus comprising:

a latent image carrying member on which an electrostatic latent image is formed;

a two-component developer carrying member which rotates while magnetically holding on an outer surface a developer containing carrier beads and toner particles, said two-component developer carrying member having a first magnetic element mounted therein;

a toner carrying member carrying on an outer surface a thin toner layer formed of the toner particles supplied from said two-component developer carrying member;

a toner collecting roller for collecting the toner particles scattered and suspended in the vicinity of said two-component developer carrying member and said toner carrying member, said toner collecting roller having a second magnetic element mounted therein;

a housing accommodating said two-component developer carrying member, said toner carrying member and said toner collecting roller; and voltage applicator for applying a development bias voltage to at least one of said toner carrying member and said two-component developer carrying member for developing the electrostatic latent image;

wherein said toner collecting roller is disposed face to face with said two-component developer carrying member, and the first and second magnetic elements are disposed to face each other with oppositely directed polarities and wherein a magnetic force acting between said toner collecting roller and said two-component developer carrying member is made larger than a magnetic force acting between said toner carrying member and said two-component developer carrying member.

10. The image forming apparatus according to claim 9, wherein said housing has an inside wall and said toner collecting roller is located between said two-component developer carrying member and the inside wall of said housing at a location downstream of an area where said two-component developer carrying member and said toner carrying member are closest to each other with respect to a rotating direction of said two-component developer carrying member.

11. The image forming apparatus according to claim 9, wherein the second magnetic element is mounted along an axial direction of said toner collecting roller, and magnetic forces produced by the second magnetic element at opposite axial end portions of said toner collecting roller are made larger than a magnetic force produced by the second magnetic element at a middle portion of said toner collecting roller.

12. The image forming apparatus according to claim 9, wherein said toner collecting roller has arithmetic mean surface roughness falling in a range of 0.505 to 3.0 μm which is higher than that of said toner carrying roller.

13. The image forming apparatus according to claim 9, wherein the voltage applicator for applying a development bias voltage to at least one of said toner carrying member and said two-component developer carrying member is a first voltage applicator, the apparatus further comprising a second voltage applicator for applying a bias voltage for collecting the scattered toner particles to said toner collecting roller.

14. The image forming apparatus according to claim 9, wherein said latent image carrying member is driven at a surface turning speed of at least 180 mm/sec.

15. The image forming apparatus according to claim 9, wherein closest facing parts of said toner collecting roller and said two-component developer carrying member move circumferentially in the same direction.

16. An image forming apparatus comprising:

a latent image carrying member on which an electrostatic latent image is formed;

a toner carrying member disposed face to face with said latent image carrying member and carrying on an outer surface toner particles for developing the electrostatic latent image;

a toner-feeding developer carrying member disposed face to face with said toner carrying member and carrying a two-component developer containing the toner particles and magnetic carrier beads for supplying the toner particles to said toner carrying member, said toner-feeding developer carrying member having toner-feeding developer carrier magnetic element mounted therein;

a toner-collecting developer carrying member disposed face to face with said toner carrying member and carrying the two-component developer for collecting the toner particles from said toner carrying member, said toner-collecting developer carrying member having toner-collecting developer carrier magnetic element mounted therein; and a toner collecting roller for collecting the toner particles scattered and suspended in the vicinity of said toner carrying member;

wherein said toner-collecting developer carrying member and said toner carrying roller are in a counter-rotation configuration so that closest facing parts of these two rollers move in opposite directions, and said toner collecting roller is disposed face to face with both said toner-collecting developer carrying member and said toner carrying member.

17. The image forming apparatus according to claim 16, wherein said toner collecting roller is provided with toner collecting roller magnetic element mounted therein, the toner-feeder developer carrier magnetic element and the toner collecting roller magnetic elements being disposed to face each other with oppositely directed polarities.

* * * * *